US009874333B2

(12) United States Patent
Lay et al.

(10) Patent No.: US 9,874,333 B2
(45) Date of Patent: Jan. 23, 2018

(54) SURFACE AMBIENT WRAP LIGHT FIXTURE

(71) Applicant: CREE, INC., Durham, NC (US)

(72) Inventors: James Michael Lay, Apex, NC (US); Jennifer Denise West, Cary, NC (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 13/958,461

(22) Filed: Aug. 2, 2013

(65) Prior Publication Data

US 2014/0268748 A1 Sep. 18, 2014

Related U.S. Application Data

(63) Continuation-in-part of application No. 13/829,558, filed on Mar. 14, 2013.

(51) Int. Cl.
*F21V 15/01* (2006.01)
*F21V 5/04* (2006.01)
(Continued)

(52) U.S. Cl.
CPC ..... *F21V 15/01* (2013.01); *F21S 8/033* (2013.01); *F21S 8/04* (2013.01); *F21S 8/06* (2013.01);
(Continued)

(58) Field of Classification Search
CPC ..... F21V 15/01; F21V 5/04
(Continued)

(56) References Cited

U.S. PATENT DOCUMENTS 3,589,660 A 6/1971 Dunckel
4,118,763 A 10/1978 Osteen ..... 359/833
(Continued)

FOREIGN PATENT DOCUMENTS

CN 1019844284 3/2011
KR 20100012997 12/2010
WO WO2008003289 1/2008 ..... F21S 4/003

OTHER PUBLICATIONS

U.S. Appl. No. 13/649,052, filed Oct. 10, 2012, Lowes, et al.
(Continued)

*Primary Examiner* — Donald Raleigh
*Assistant Examiner* — Jacob R Stern
(74) *Attorney, Agent, or Firm* — Koppel, Patrick, Heybl & Philpott

(57) ABSTRACT

A modular fixture that is well-suited for use with solid state light sources, such as LEDs, to provide a surface ambient light (SAL). The fixture comprises two structural components: a housing subassembly and a lighting subassembly. These two subassemblies may be removably attached to operate as a singular fixture. Many different lighting subassemblies may be compatible with a single housing subassembly and vice versa. The housing subassembly comprises a frame that is mountable to an external structure. The lighting subassembly comprises the light sources and optical elements that tailor the light to achieve a particular profile. Electronics necessary to power and control the light sources may be disposed in the lighting subassembly. Various mount mechanisms may be used to attach the fixture to a surface such as a ceiling or a wall. Multiple fixtures can be connected serially to provide an extended linear fixture.

32 Claims, 14 Drawing Sheets

(51) Int. Cl.

| | |
|---|---|
| ***F21S 8/00*** | (2006.01) |
| ***F21S 8/04*** | (2006.01) |
| ***F21S 8/06*** | (2006.01) |
| ***F21S 9/02*** | (2006.01) |
| ***F21V 15/015*** | (2006.01) |
| ***F21V 23/00*** | (2015.01) |
| ***F21V 23/02*** | (2006.01) |
| *F21S 2/00* | (2016.01) |
| *F21V 7/00* | (2006.01) |
| *F21V 21/005* | (2006.01) |
| *F21V 23/04* | (2006.01) |
| *F21Y 105/12* | (2016.01) |
| *F21Y 105/10* | (2016.01) |
| *F21Y 103/10* | (2016.01) |
| *F21Y 115/10* | (2016.01) |
| *F21Y 113/13* | (2016.01) |

(52) U.S. Cl.

CPC ..... *F21S 9/022* (2013.01); *F21V 15/015* (2013.01); *F21V 23/009* (2013.01); *F21V 23/02* (2013.01); *F21S 2/00* (2013.01); *F21V 5/04* (2013.01); *F21V 7/005* (2013.01); *F21V 21/005* (2013.01); *F21V 23/0442* (2013.01); *F21Y 2103/10* (2016.08); *F21Y 2105/10* (2016.08); *F21Y 2105/12* (2016.08); *F21Y 2113/13* (2016.08); *F21Y 2115/10* (2016.08)

(58) Field of Classification Search

USPC ..... 362/190, 217.05, 497, 221, 217.04

See application file for complete search history.

(56) References Cited

U.S. PATENT DOCUMENTS

| | | | | |
|---|---|---|---|---|
| 4,300,185 | A | 11/1981 | Wakamatsu | 362/147 |
| 4,464,707 | A | 8/1984 | Forrest | 362/271.06 |
| 4,472,767 | A | 9/1984 | Wenman | 362/147 |
| 4,946,547 | A | 8/1990 | Palmour et al. | |
| 5,200,022 | A | 4/1993 | Kong et al. | |
| 5,335,890 | A | 8/1994 | Pryor | |
| RE34,861 | E | 2/1995 | Davis et al. | |
| 5,530,628 | A | 6/1996 | Ngai | 362/127 |
| 5,653,412 | A | 8/1997 | Martorano | |
| 5,690,415 | A | 11/1997 | Krehl | 362/125 |
| 5,823,663 | A | 10/1998 | Bell et al. | |
| 5,907,218 | A | 5/1999 | Altman | |
| 5,951,150 | A * | 9/1999 | Helstern | 362/293 |
| 6,190,198 | B1 | 2/2001 | Ray | |
| 6,210,025 | B1 | 4/2001 | Schmidt et al. | |
| 6,435,697 | B1 * | 8/2002 | Simmons | F21V 17/107 362/219 |
| 6,536,924 | B2 * | 3/2003 | Segretto | F21S 2/005 362/247 |
| 6,667,451 | B1 * | 12/2003 | Hart | 200/314 |
| 6,739,734 | B1 | 5/2004 | Hulgan | 362/243 |
| 6,914,194 | B2 | 7/2005 | Fan | |
| 7,131,747 | B1 | 11/2006 | Yates | 362/219 |
| 7,213,940 | B1 | 5/2007 | Van de Ven et al. | |
| 7,217,023 | B2 | 5/2007 | Iwasa et al. | 362/555 |
| 7,228,253 | B2 | 6/2007 | Chen | 318/11 |
| 7,387,410 | B2 | 6/2008 | Sibout | 362/375 |
| 7,520,636 | B2 | 4/2009 | Van Der Poel | |
| 7,540,627 | B2 | 6/2009 | Handsaker | 362/225 |
| 7,559,672 | B1 | 7/2009 | Parkyn | |
| 7,591,578 | B2 | 9/2009 | Chang | |
| 7,628,506 | B2 | 12/2009 | Verfuerth et al. | 362/218 |
| 7,654,703 | B2 | 2/2010 | Kan et al. | 362/362 |
| 7,674,005 | B2 | 3/2010 | Chung | 362/147 |
| 7,722,220 | B2 | 5/2010 | Van De Ven et al. | |
| 7,758,207 | B1 | 7/2010 | Zhou | 362/217.1 |
| 7,791,061 | B2 | 9/2010 | Edmond et al. | |
| 8,058,088 | B2 | 11/2011 | Cannon et al. | |
| 8,206,004 | B2 | 6/2012 | Serak et al. | 362/217 |
| 8,220,953 | B1 | 7/2012 | Moore | 362/217.01 |
| 8,313,212 | B1 | 11/2012 | Mayer et al. | 362/219 |
| 8,317,369 | B2 | 11/2012 | McCanless | 362/368 |
| 8,342,714 | B1 | 1/2013 | Rea | 362/264 |
| 8,360,599 | B2 | 1/2013 | Ivey | |
| 8,376,578 | B2 | 2/2013 | Kong, II | 362/241 |
| 8,388,180 | B2 | 3/2013 | Chang | |
| 8,459,824 | B1 | 6/2013 | Esmailzadeh et al. | 362/147 |
| 8,523,383 | B1 | 9/2013 | Grigore et al. | 362/221 |
| 8,678,611 | B2 | 3/2014 | Chu | 313/110 |
| 8,714,770 | B2 | 5/2014 | Kato | 362/217.06 |
| 8,764,220 | B2 | 7/2014 | Chan et al. | 362/217.02 |
| 8,777,448 | B2 | 7/2014 | Shimizu | 362/235 |
| 8,888,314 | B2 | 11/2014 | Gill | |
| 9,057,493 | B2 | 6/2015 | Simon | |
| 2001/0048599 | A1 | 12/2001 | Hess | 362/290 |
| 2004/0109330 | A1 | 6/2004 | Pare | |
| 2004/0240214 | A1 | 12/2004 | Whitlow et al. | 362/373 |
| 2004/0252521 | A1 | 12/2004 | Clark | 362/554 |
| 2005/0041418 | A1 * | 2/2005 | Fan | F21V 23/008 362/217.05 |
| 2005/0146867 | A1 | 7/2005 | Kassay | 362/217.05 |
| 2006/0050505 | A1 | 3/2006 | McCarthy | 362/219 |
| 2006/0266955 | A1 | 11/2006 | Arvin | 250/492.1 |
| 2006/0278882 | A1 | 12/2006 | Leung | 257/98 |
| 2007/0158668 | A1 | 7/2007 | Tarsa et al. | |
| 2007/0171647 | A1 | 7/2007 | Artwohl | |
| 2008/0128723 | A1 | 6/2008 | Pang | |
| 2008/0173884 | A1 | 7/2008 | Chitnis et al. | |
| 2008/0179611 | A1 | 7/2008 | Chitnis et al. | |
| 2008/0258130 | A1 | 10/2008 | Bergmann et al. | |
| 2008/0285267 | A1 | 11/2008 | Santoro | 362/224 |
| 2008/0314944 | A1 | 12/2008 | Tsai | 224/331 |
| 2009/0009999 | A1 | 1/2009 | Wang | |
| 2009/0040782 | A1 | 2/2009 | Liu et al. | 362/555 |
| 2009/0046457 | A1 | 2/2009 | Everhart | 362/235 |
| 2009/0161356 | A1 | 6/2009 | Negley et al. | 362/231 |
| 2009/0184333 | A1 | 7/2009 | Wang et al. | |
| 2009/0185379 | A1 | 7/2009 | Chen | |
| 2009/0207602 | A1 | 8/2009 | Reed et al. | 362/225 |
| 2009/0212304 | A1 | 8/2009 | Wang et al. | |
| 2009/0224265 | A1 | 9/2009 | Wang et al. | |
| 2009/0290345 | A1 | 11/2009 | Shaner | 362/249.01 |
| 2009/0290348 | A1 | 11/2009 | Van Laanen et al. | 362/249 |
| 2009/0296381 | A1 * | 12/2009 | Dubord | 362/218 |
| 2010/0002426 | A1 | 1/2010 | Wu | 362/223 |
| 2010/0014289 | A1 | 1/2010 | Thomas | 362/235 |
| 2010/0110701 | A1 | 5/2010 | Liu | 362/373 |
| 2010/0128485 | A1 | 5/2010 | Teng | 362/294 |
| 2010/0142205 | A1 | 6/2010 | Bishop | 362/249.02 |
| 2010/0155763 | A1 | 6/2010 | Donofrio et al. | |
| 2010/0171404 | A1 | 7/2010 | Liu et al. | 313/46 |
| 2010/0214770 | A1 | 8/2010 | Anderson | 362/133 |
| 2010/0220469 | A1 | 9/2010 | Ivey et al. | 362/218 |
| 2010/0259927 | A1 | 10/2010 | Chien | 362/235 |
| 2010/0328945 | A1 | 12/2010 | Song et al. | 362/240 |
| 2011/0006688 | A1 | 1/2011 | Shim | 315/119 |
| 2011/0007514 | A1 | 1/2011 | Sloan | 362/368 |
| 2011/0013400 | A1 | 1/2011 | Kanno et al. | |
| 2011/0028006 | A1 | 2/2011 | Shah et al. | 439/39 |
| 2011/0090682 | A1 | 4/2011 | Zheng | 362/218 |
| 2011/0103043 | A1 | 5/2011 | Ago | 362/147 |
| 2011/0163683 | A1 | 7/2011 | Steele et al. | 315/192 |
| 2011/0211330 | A1 | 9/2011 | Wang | 362/20 |
| 2011/0222270 | A1 | 9/2011 | Porciatti | |
| 2011/0235319 | A1 * | 9/2011 | Fukano | F21V 23/06 362/217.14 |
| 2011/0285314 | A1 | 11/2011 | Carney et al. | 315/294 |
| 2011/0286206 | A1 | 11/2011 | Tucker | 362/217.1 |
| 2011/0286207 | A1 | 11/2011 | Chan et al. | 362/217.1 |
| 2011/0310604 | A1 | 12/2011 | Shimizu | 362/235 |
| 2011/0310614 | A1 | 12/2011 | Budike, Jr. | 362/294 |
| 2012/0002408 | A1 | 1/2012 | Lichten et al. | 362/218 |
| 2012/0020109 | A1 | 1/2012 | Kim | |
| 2012/0051041 | A1 | 3/2012 | Edmond | 362/231 |
| 2012/0075857 | A1 | 3/2012 | Verbrugh | 362/249 |
| 2012/0081883 | A1 | 4/2012 | Wang | 362/101 |
| 2012/0092876 | A1 | 4/2012 | Chang | |

(56) References Cited

U.S. PATENT DOCUMENTS

| | | | | |
|---|---|---|---|---|
| 2012/0098424 | A1 | 4/2012 | Arik | 315/35 |
| 2012/0120666 | A1 | 5/2012 | Moeller | 362/308 |
| 2012/0169234 | A1 | 7/2012 | Shew | 315/88 |
| 2012/0182755 | A1 | 7/2012 | Wildner | 362/555 |
| 2012/0218757 | A1 | 8/2012 | Gill | 362/235 |
| 2012/0235199 | A1 | 9/2012 | Andrews et al. | |
| 2012/0250302 | A1 | 10/2012 | Edwards | 362/223 |
| 2013/0021803 | A1 | 1/2013 | Pickard | |
| 2013/0039090 | A1 | 2/2013 | Dau | 362/551 |
| 2013/0050998 | A1 | 2/2013 | Chu et al. | 362/218 |
| 2013/0093359 | A1 | 4/2013 | Hsu | |
| 2013/0094225 | A1 | 4/2013 | Leichner | 362/368 |
| 2013/0155670 | A1 | 6/2013 | Handsaker | 362/223 |
| 2013/0242548 | A1 | 9/2013 | Ter-Hovhannisyan | |
| 2013/0258616 | A1 | 10/2013 | Chao | 361/752 |
| 2013/0271979 | A1 | 10/2013 | Pearson et al. | 362/235 |
| 2013/0279156 | A1 | 10/2013 | Kaule | 362/133 |
| 2013/0279180 | A1 | 10/2013 | Pearson et al. | 362/371 |
| 2013/0329425 | A1 | 12/2013 | Lowes et al. | |
| 2014/0085861 | A1 | 3/2014 | Nicolai | 362/84 |
| 2014/0265809 | A1 | 9/2014 | Hussell | |
| 2015/0016100 | A1 | 1/2015 | Ishii | 362/223 |
| 2015/0022999 | A1 | 1/2015 | Yu | |
| 2016/0025278 | A1 | 1/2016 | Camarota | |

OTHER PUBLICATIONS

U.S. Appl. No. 13/649,067, filed Oct. 10, 2012, Lowes, et al.
U.S. Appl. No. 13/770,389, filed Feb. 19, 2013, Lowes, et al.
U.S. Appl. No. 13/782,820, filed Mar. 1, 2013, Dixon,et al.
U.S. Appl. No. 12/873,303, filed Aug. 31, 2010, Edmond, et al.
U.S. Appl. No. 13/345,215, filed Jan. 6, 2012, Lu, et al.
U.S. Appl. No. 13/442,311, filed Apr. 9, 2012, Lu, et al.
U.S. Appl. No. 12/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
U.S. Appl. No. 13/830,698, filed Mar. 14, 2013, Durkee, et al.
U.S. Appl. No. 29/462,422, filed Aug. 2, 2013, Lay, et al.
CircalokTM conductive adhesive, 6972 and 6968, by Lord Corporation, 2 pages.
WhiteOpticstm White97 Film, Reflector Film Technical Data Sheet, WhiteOptics, LLc. New Castle, DE.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet, 1 page, from www.leviton.com.
Restriction Requirement from U.S. Appl. No. 13/839,130, dated Jul. 28, 2014.
Office Action from U.S. Appl. No. 13/839,130, dated Sep. 25, 2014.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 14/252,685, dated Oct. 1, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,820, dated Oct. 30, 2015.
Office Action from U.S. Appl. No. 13/899,314, dated Nov. 13, 2015.
Response to OA from U.S. Appl. No. 13/899,314, filed Dec. 16, 2015.
Office Action from U.S. Appl. No. 13/672,592, dated Nov. 23, 2015.
Office Action from U.S. Appl. No. 14/020,750, dated Dec. 14, 2015.
Office Action from U.S. Appl. No. 14/108,168, filed Dec. 24, 2015.
Office Action from U.S. Appl. No. 13/842,150, filed Dec. 30, 2015.
Office Action from U.S. Appl. No. 13/763,270, filed Jan. 12, 2016.
Office Action from U.S. Appl. No. 13/899,314, filed Feb. 4, 2016.
Office Action from U.S. Appl. No. 14/070,098, filed Feb. 5, 2016.
Office Action from U.S. Appl. No. 13/829,558, filed Feb. 19, 2016.
Office Action from U.S. Appl. No. 13/910,486, dated Mar. 1, 2016.
Office Action from U.S. Appl. No. 14/108,168, dated May 20, 2016.
Office Action from U.S. Appl. No. 14/252,685, dated May 20, 2016.
Office Action from U.S. Appl. No. 13/899,314, dated Jul. 29, 2015.
Response to OA from U.S. Appl. No. 13/899,314, dated Sep. 15, 2015.
Office Action from U.S. Appl. No. 13/672,592, dated Aug. 6, 2015.
Response to OA from U.S. Appl. No. 13/672,592, dated Sep. 21, 2015.
Office Action from U.S. Appl. No. 13/842,150, dated Oct. 10, 2015.
Office Action from U.S. Appl. No. 13/829,558, dated Sep. 11, 2015.
Office Action for U.S. Appl. No. 13/910,486, dated Jun. 23, 2016.
Office Action for U.S. Appl. No. 13/763,270, dated Jul. 15, 2016.
Office Action from U.S. Appl. No. 14/020,750, dated Jul. 20, 2016.
Office Action from U.S. Appl. No. 13/829,558, dated Aug. 16, 2016.
Office Action from U.S. Appl. No. 14/070,098, dated Sep. 9, 2016.
Chinese Office Action Application No. 201310236572; dated Jan. 4, 2017.
Office Action for U.S. Appl. No. 14/020,750; dated Jan. 25, 2017.
Office Action for U.S. Appl. No. 13/910,486; dated Aug. 28, 2017.
Office Action for U.S. Appl. No. 13/829,558; dated Oct. 4, 2017.
Office Action for U.S. Appl. No. 14/252,685; dated Oct. 20, 2017.
Office Action for U.S. Appl. No. 14/070,098; dated Oct. 23, 2017.
Office Action for U.S. Appl. No. 14/108,168; dated Nov. 2, 2017.

* cited by examiner

FIG. 1
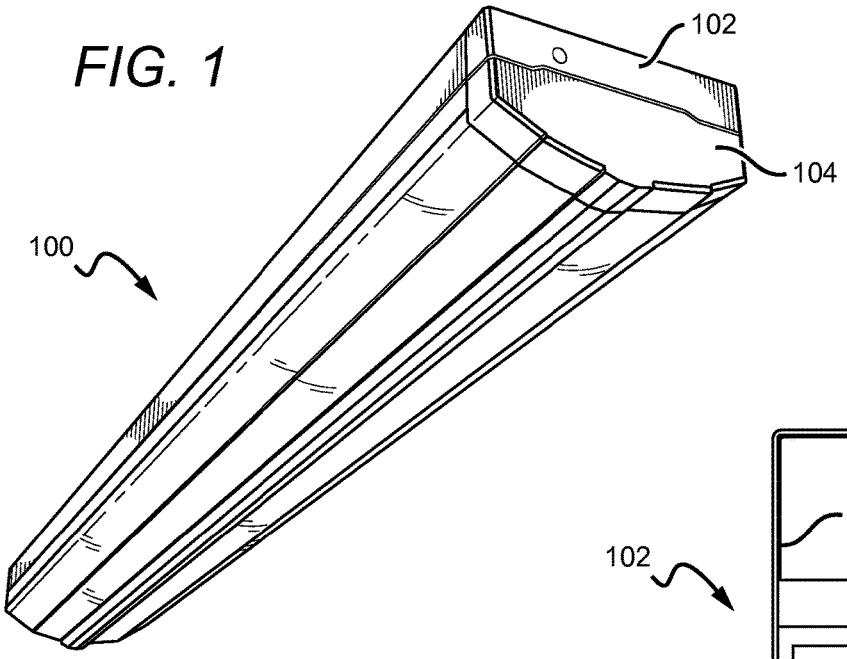
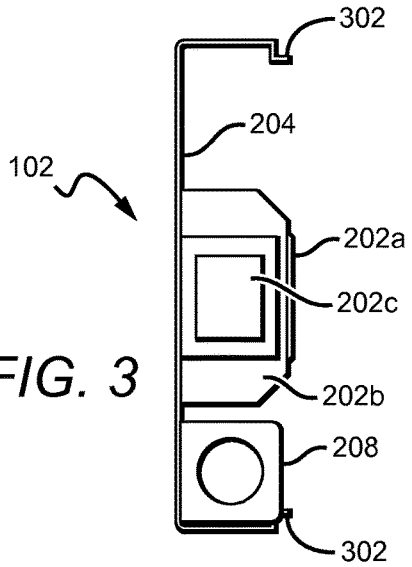
FIG. 3
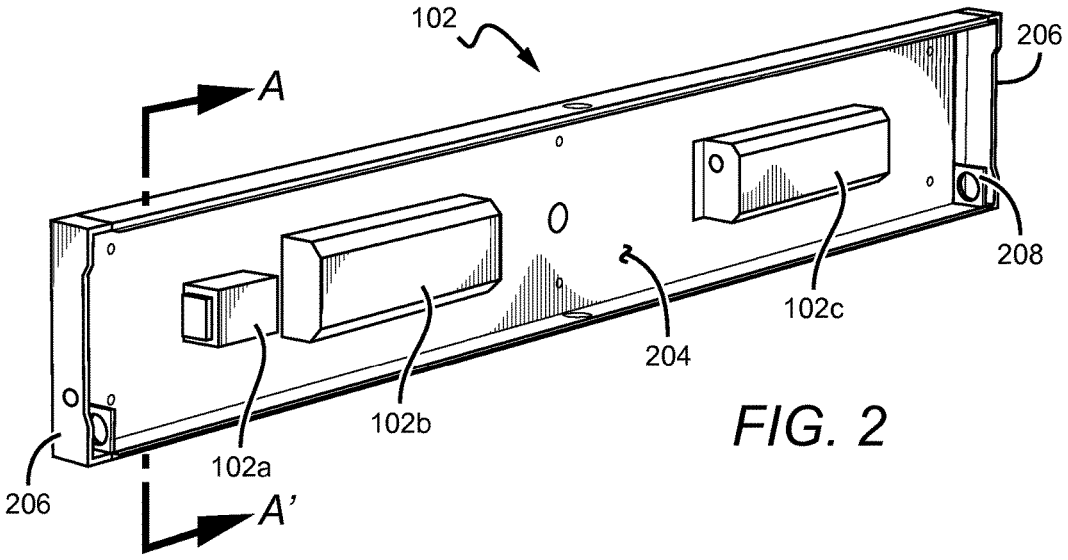
FIG. 2

FIG. 4a
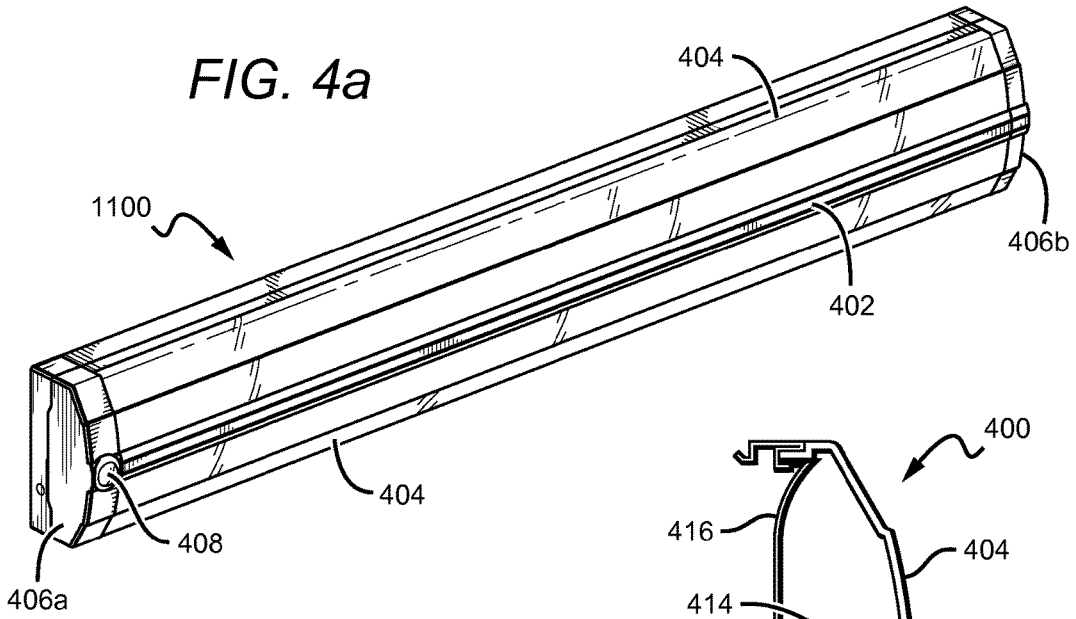
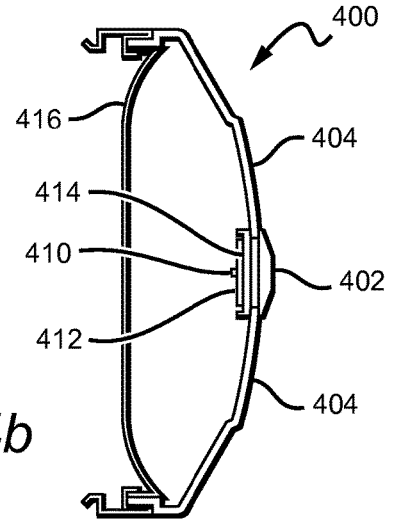
FIG. 4b
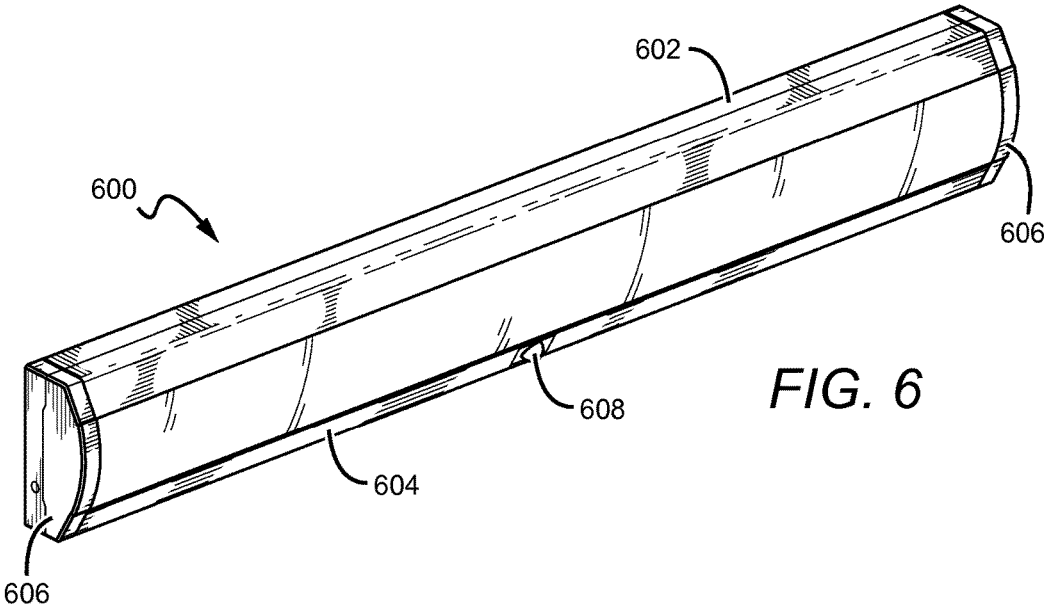
FIG. 6

FIG. 13a
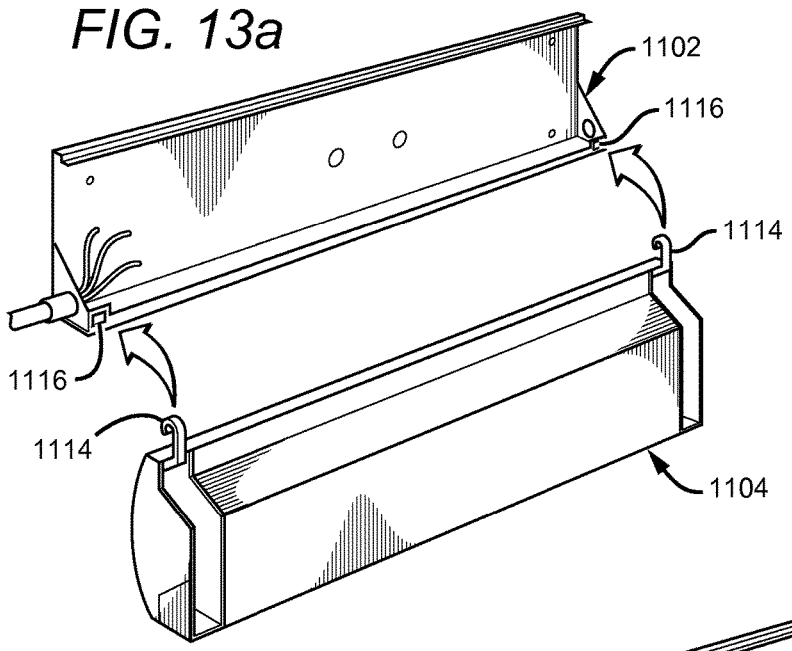
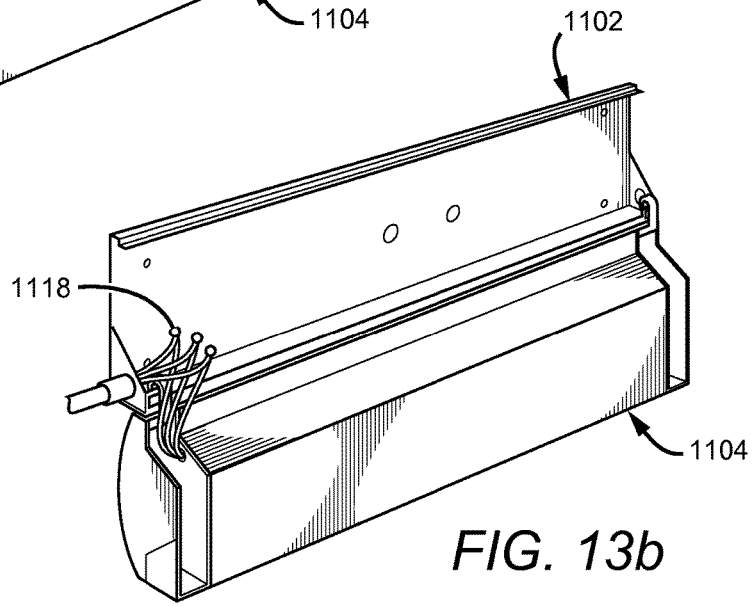
FIG. 13b
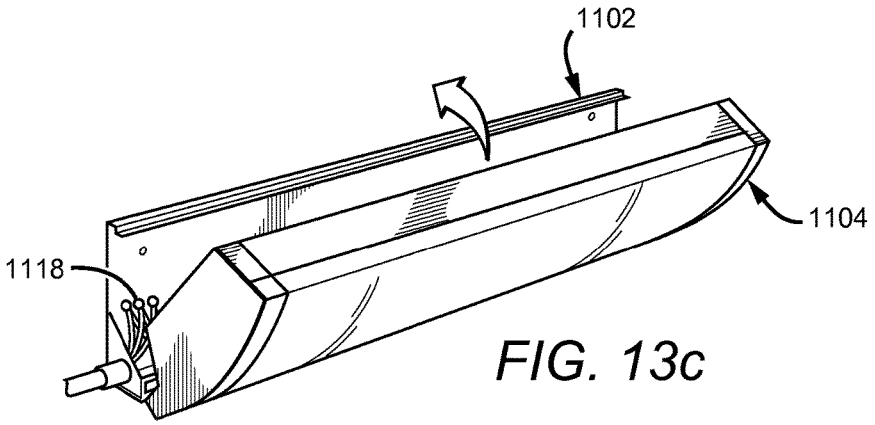
FIG. 13c

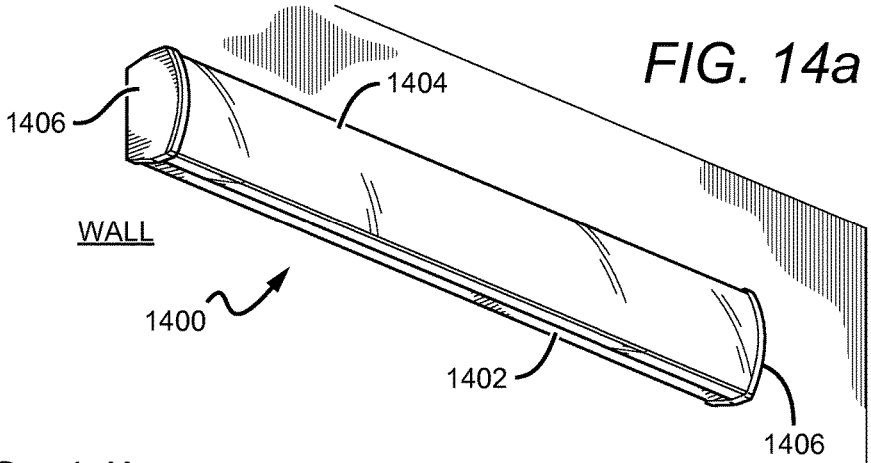
FIG. 14a
FIG. 14b
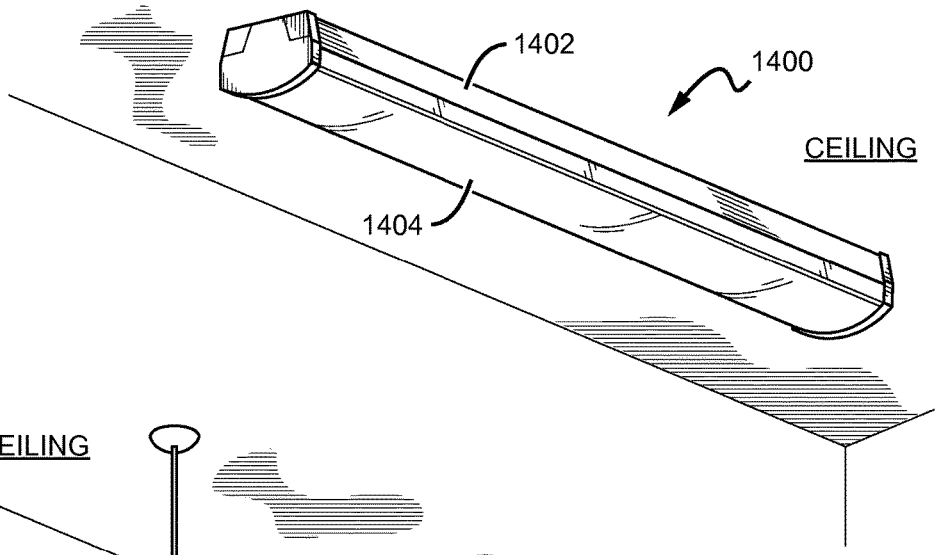
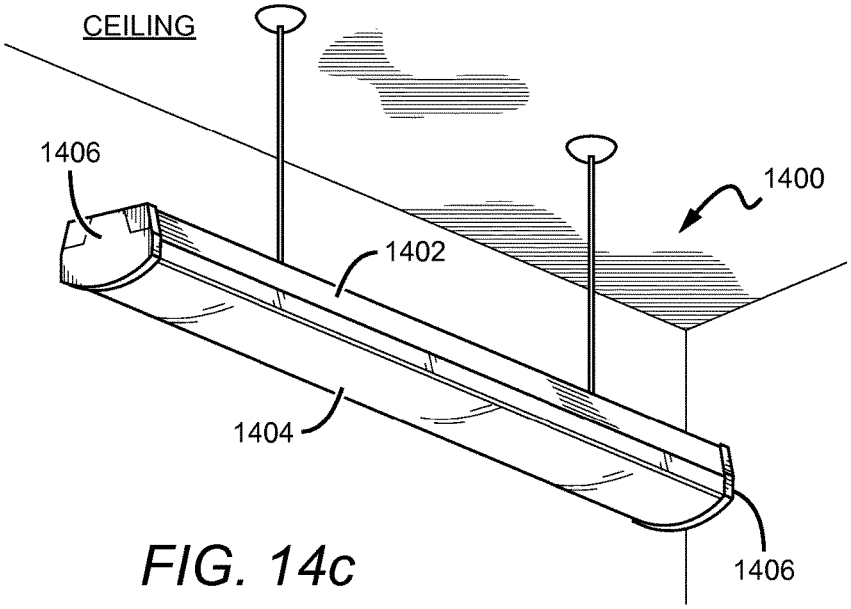
FIG. 14c

FIG. 19
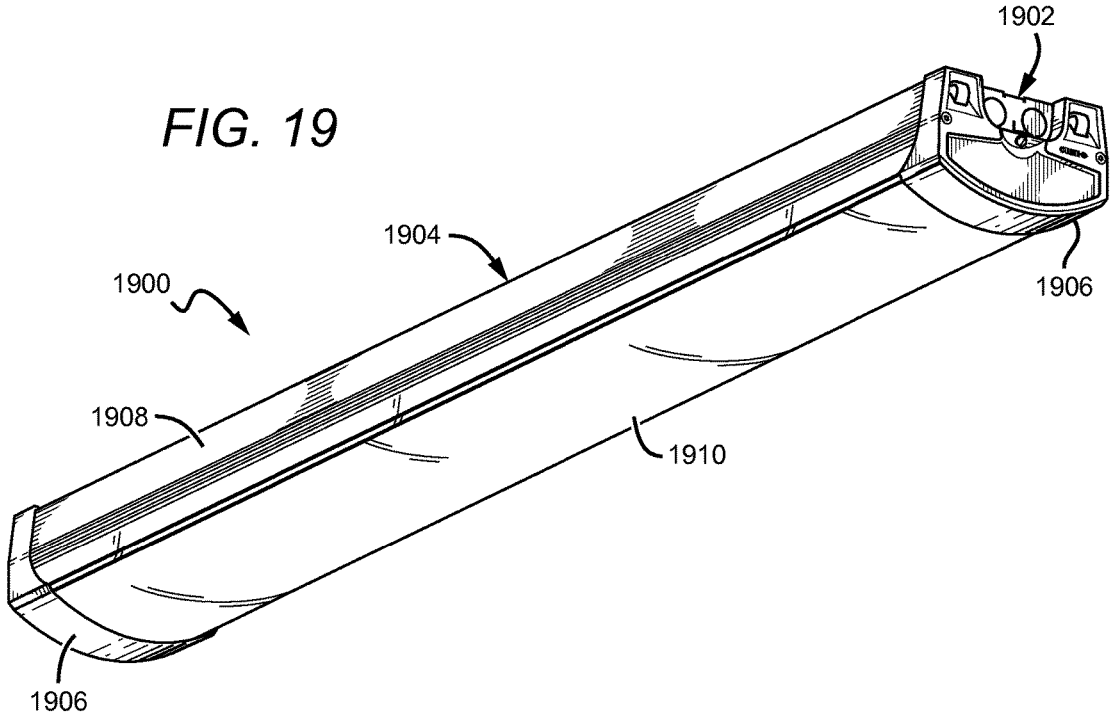
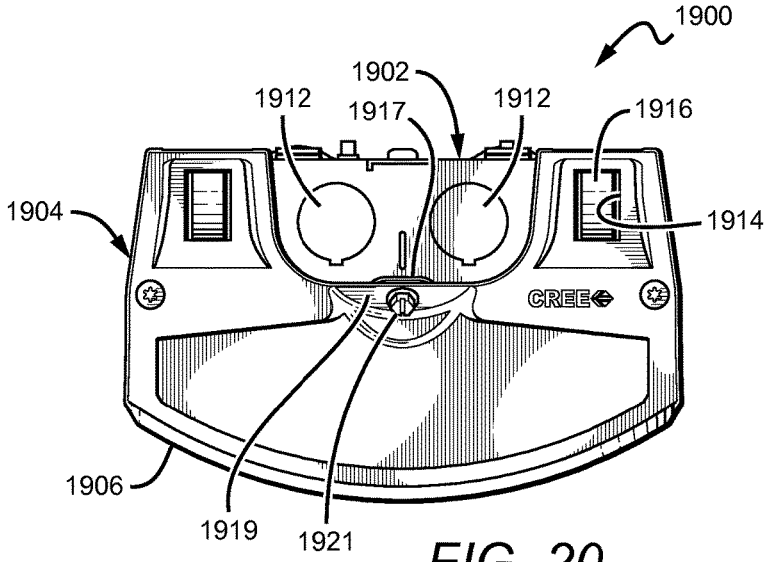
FIG. 20

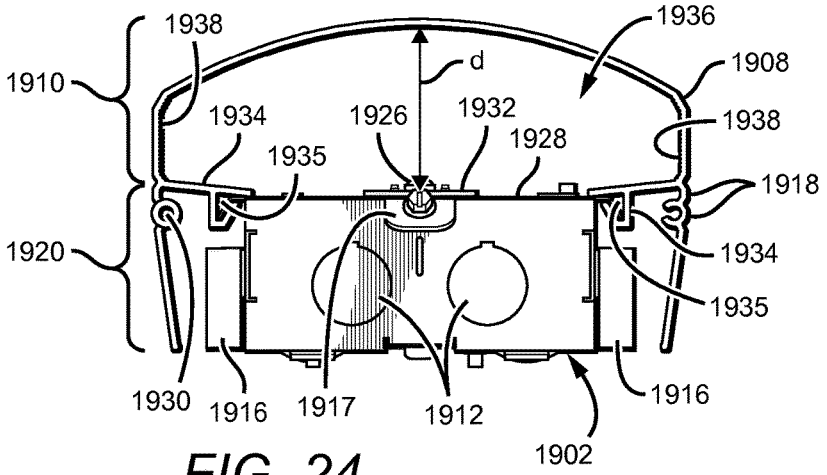
FIG. 24
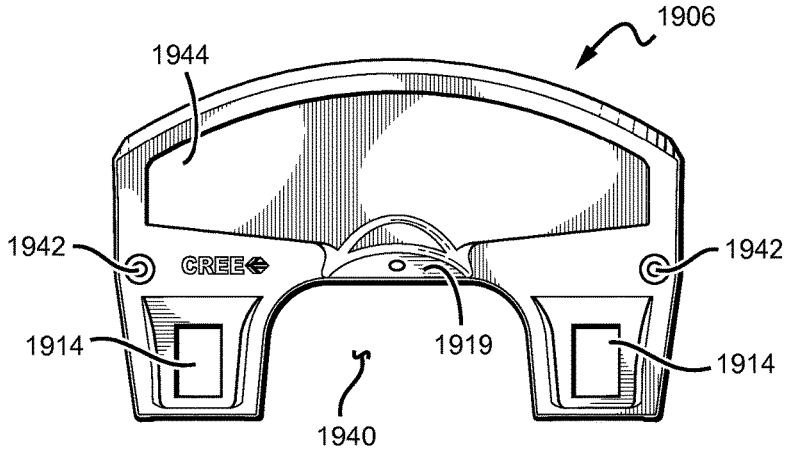
FIG. 25
FIG. 29
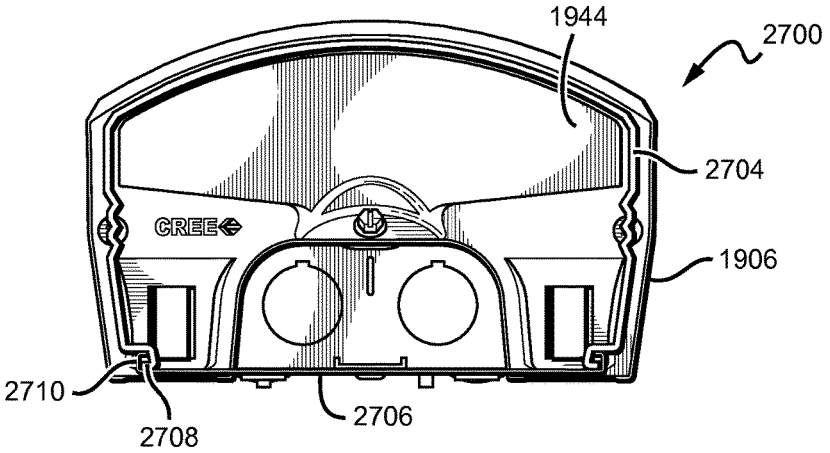

SURFACE AMBIENT WRAP LIGHT FIXTURE

RELATED APPLICATIONS

This application is a continuation-in-part of U.S. patent application Ser. No. 13/829,558, filed on 14 Mar. 2013, which is incorporated by reference as if fully set forth herein.

BACKGROUND OF THE INVENTION

Field of the Invention

The invention relates to lighting fixtures and, more particularly, to modular lighting fixtures that are well-suited for use with solid state lighting sources, such as light emitting diodes (LEDs).

Description of the Related Art

Troffer-style fixtures (troffers) are ubiquitous in commercial office and industrial spaces throughout the world. In many instances these troffers house elongated fluorescent light bulbs that span the length of the troffer. Troffers may be mounted to or suspended from ceilings or walls. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that which often extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

An embodiment of a modular light fixture comprises the following elements. A housing subassembly is removably attached to a lighting subassembly. The lighting subassembly comprises at least one light source. Driver electronics are connected to control said at least one light source.

An embodiment of a modular light fixture comprises the following elements. A housing subassembly and a lighting subassembly are removably attached. The lighting subassembly comprises a body, a back reflector at least partially surrounded by the body, a heat sink with a mount surface mounted proximate to the back reflector, a plurality of light sources on the mount surface positioned such that at least a portion of the light emitted initially impinges on the back reflector, and a lens attached to the body, the lens configured to transmit at least a portion of light from the at least one light source. Driver electronics are connected to control the plurality of light sources.

An embodiment of a modular light fixture comprises the following elements. A housing subassembly is removably amounted to a lighting subassembly. The housing subassembly comprises an external mount mechanism. The lighting subassembly comprises at least one light source and driver electronics.

An embodiment of an extendable linear fixture comprises the following elements. A plurality of modular fixtures each comprises a lighting subassembly that is removably attached to a housing subassembly. The housing subassembly comprises an external mount mechanism. The lighting subassembly comprises at least one light source. At least one joiner structure is between adjacent of said modular fixtures, connecting said modular fixtures together.

BRIEF DESCRIPTION OF THE DRAWINGS

FIG. 1 is a perspective view of a modular light fixture according to an embodiment of the present invention.

FIG. 2 is a perspective view of a housing subassembly according to an embodiment of the present invention.

FIG. 3 is a cutaway side view of the housing subassembly 102 along cut line A-A'.

FIG. 4*a* is a perspective view of a lighting subassembly according to an embodiment of the present invention. FIG. 4*b* is a cross-sectional view thereof.

FIG. 6 is a perspective view of another lighting subassembly that may be used in embodiments of the present invention.

FIGS. 13*a-c* show perspective views of a modular light fixture according to an embodiment of the present invention during various stages of installation.

FIGS. 14*a-c* are perspective views of a modular light fixture according to an embodiment of the present invention.

FIG. 19 is a perspective view of a modular light fixture according to an embodiment of the present invention.

FIG. 20 is a right end elevation view of the light fixture according to an embodiment of the present invention.

FIG. 24 is an elevation view of the fixture according to an embodiment of the present invention with the end cap removed to reveal the internal elements.

FIG. 25 is an elevation view of the end cap which may be used in fixtures according to embodiments of the present invention.

FIG. 29 is a right side elevation view of the extendable fixture along a transverse cutline bisecting the bridge structure according to an embodiment of the present invention.

DETAILED DESCRIPTION OF THE INVENTION

Figure 5A:
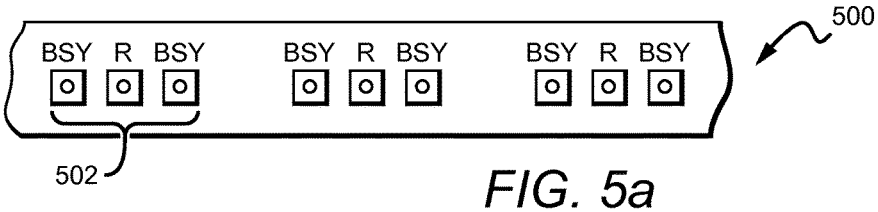
FIGS. 5*a-c* show a top plan view of portions of several light strips that may be used in embodiments of the present invention.

Embodiments of the present invention provide an indirect modular fixture that is particularly well-suited for use with solid state light sources, such as LEDs, to provide a surface ambient light (SAL). The fixture comprises two structural components: a housing subassembly and a lighting subassembly. These two subassemblies may be removably attached to operate as a singular fixture. Many different lighting subassemblies may be compatible with a single housing subassembly and vice versa. The housing subassembly comprises a frame that is mountable to an external structure. The lighting subassembly comprises the light sources and optical elements that tailor the outgoing light to achieve a particular profile. Both the shape and the arrangement of these elements provide the desired light output distribution. Electronics necessary to power and control the light sources may be disposed in either the housing subassembly or the lighting subassembly. Structural elements, such as end caps, may be used to hold the fixture elements and the subassemblies in position relative to each other. Various mount mechanisms may be used to attach the fixture to a surface such as a ceiling or a wall.

FIG. 1 is a perspective view of a modular light fixture 100 according to an embodiment of the present invention. The fixture 100 is particularly well-suited for use with solid state light emitters, such as LEDs or vertical cavity surface emitting lasers (VCSELs), for example. However, other kinds of light sources may also be used. The elongated fixture 100 comprises a housing subassembly 102 and a lighting subassembly 104. The two subassemblies 102, 104 are removably attached as shown. When assembled, the subassemblies 102, 104 define an internal cavity that houses several elements including the light sources and the driver electronics as shown in detail herein. The housing subassembly 102 is designed to work with many different lighting subassemblies such that they may be easily replaced to achieve a particular lighting effect, for example. Several examples of lighting subassemblies are discussed herein.

FIG. 2 is a perspective view of a housing subassembly 102 according to an embodiment of the present invention. In this embodiment, the housing subassembly 102 is designed to house driver electronics 202 which are mounted on an interior mount surface 204. The housing subassembly 102 comprises a first end cap portion 206 on both ends of the subassembly 102. At least one of the first end cap portions 206 has a receiving structure 208 designed to mate with a second end cap portion (not shown) on the lighting subassembly 104 as shown in more detail herein.

In this embodiment, the driver electronic component boxes comprise a backup battery box 202*a*, a driver box 202*b*, and a step-down converter box 202*c*. The step-down converter box 202*c* is an optional element that may be included in models requiring a non-standard voltage, for example, models for use in Canada or another country. Many different mount arrangements are possible to accommodate the necessary electronic components within the housing subassembly 102, and many different combinations of electronic components may be used.

FIG. 3 is a cutaway side view of the housing subassembly 102 along cut line A-A'. The electronic components 102*a*, 102*b*, 102*c* are mounted on the interior mount surface 204 along the longitudinal axis of the housing subassembly 102. Tabs 302 are used to aid in connecting the housing subassembly 102 with the lighting subassembly 104. The housing subassembly 102 is configured to receive many different lighting subassemblies to provide a fixture having a desired optical effect. Thus, the housing subassembly 102 functions as a universal receiving structure for various embodiments of lighting subassemblies as discussed in more detail herein.

In one embodiment the electronic components comprise a step-down converter 102*a*, a driver circuit 102*b*, and a battery backup 102*c*. At the most basic level a driver circuit may comprise an AC/DC converter, a DC/DC converter, or both. In one embodiment, the driver circuit comprises an AC/DC converter and a DC/DC converter both of which are located in the housing subassembly 102. In another embodiment, the AC/DC conversion is done in the housing subassembly 102, and the DC/DC conversion is done in the lighting subassembly 104. Another embodiment uses the opposite configuration where the DC/DC conversion is done in the housing subassembly 102, and the AC/DC conversion is done in the lighting subassembly 104. In yet another embodiment, both the AC/DC converter and the DC/DC converter are located in the lighting subassembly 104. It is understood that the various electronic components may distributed in different ways in one or both of the subassemblies 102, 104.

FIG. 4*a* is a perspective view of an embodiment of a lighting subassembly 400. FIG. 4*b* is a cross-sectional view of the lighting subassembly 400. This particular embodiment comprises an elongated heat sink 402 and a pair of lenses 404 that run longitudinally between first and second end caps 406*a*, 406*b* which function to hold the heat sink 402 and the lenses 404 together. The lighting subassembly 400 includes an optional sensor 408 which is housed in the end cap 406*a*.

Information from the sensor 408 is used to control the on/off state of the internal light sources to conserve energy when lighting in a particular area is not needed. The sensor may also be used to regulate the brightness of the sources, allowing for high and low modes of operation. In one embodiment, a passive infrared (PIR) sensor 408 is used to determine when a person is in the vicinity of the fixture and thus would require light in the area. When the sensor detects a person, a signal is sent to the driver circuit and the lights are turned on, or if the lights remain on at all times, then the lights are switched to the high mode of operation. When the heat signature is no longer present, then the sources switch back to the default state (e.g., off or low mode). Many other types of sensors may be used such as a motion detector or an ultrasonic sensor, for example.

FIG. 4*b* is a cross-sectional view of the lighting subassembly 400. In this embodiment, at least one LED 410 on a light strip 412 is mounted on an internal surface 414 of the heat sink 402. The LEDs 410 can also be mounted to other internal surfaces inside the optical chamber. When powered, the LEDs 410 emit light in a direction such that it is incident on a back reflector 416. The back reflector 416 then redirects at least a portion of the light out of the optical chamber through the lenses 404.

In this embodiment, the back side of the heat sink 402 functions as an internal surface of the lighting subassembly 400. The heat sink 402 can be constructed using many different thermally conductive materials. For example, the heat sink 402 may comprise an aluminum body. Similarly as the back reflector 416, the heat sink 402 can be extruded for efficient, cost-effective production and convenient scalability. In other embodiments, the heat sink 402 can be integrated with a printed circuit board (PCB), for example. Indeed the PCB itself may function as the heat sink, so long as the PCB is capable of handling thermal transmission of the heat load. Many other heat sink structures are possible.

Figure 5B:
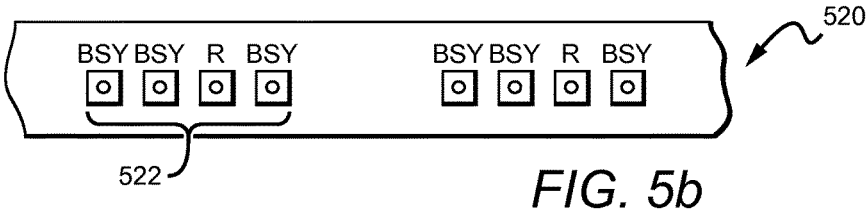
Figure 5C:
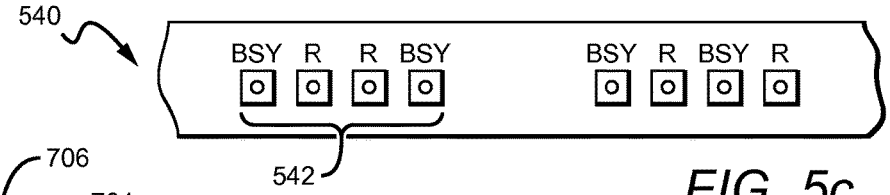

The heat sink 402 can be mounted to the lighting subassembly 400 using various methods such as, screws, pins, or adhesive, for example. In this particular embodiment, the heat sink 402 comprises an elongated thin body with a substantially flat area internal surface 414 on which one or more light sources can be mounted. The flat area provides for good thermal communication between the heat sink 402 and the light sources 410 mounted thereon. In some embodiments, the light sources will be pre-mounted on light strips. FIGS. 5*a-c* show a top plan view of portions of several light strips 500, 520, 540 that may be used to mount multiple LEDs to the heat sink 118, and in some embodiments a sink may be integrated with the light strips 500, 520, 540. As previously mentioned, although LEDs are used as the light sources in various embodiments described herein, it is understood that other light sources, such as laser diodes for example, may be substituted in as the light sources in other embodiments.

Many industrial, commercial, and residential applications call for white light sources. Embodiments of lighting subassemblies may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range from 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multi-color source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 500, 520, 540 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 500 includes clusters 502 of discrete LEDs, with each LED within the cluster 502 spaced a distance from the next LED, and each cluster 502 spaced a distance from the next cluster 502. If the LEDs within a cluster are spaced at too great distance from one another, the colors of the individual sources may become visible, causing unwanted color-striping. The clusters on the light strips can be compact. In some embodiments, an acceptable range of distances for separating consecutive LEDs within a cluster is not more than approximately 8 mm.

The scheme shown in FIG. 5*a* uses a series of clusters 502 having two blue-shifted-yellow LEDs ("BSY") and a single red LED ("R"). Once properly mixed the resultant output light will have a "warm white" appearance.

The lighting strip 520 includes clusters 522 of discrete LEDs. The scheme shown in FIG. 5*b* uses a series of clusters 522 having three BSY LEDs and a single red LED. This scheme will also yield a warm white output when sufficiently mixed.

The lighting strip 540 includes clusters 542 of discrete LEDs. The scheme shown in FIG. 5*c* uses a series of clusters 542 having two BSY LEDs and two red LEDs. This scheme will also yield a warm white output when sufficiently mixed.

The lighting schemes shown in FIGS. 5*a-c* are meant to be exemplary. Thus, it is understood that many different LED combinations can be used in concert with known conversion techniques to generate a desired output light color.

Again with reference to FIG. 4*b*, the back reflector 416 can be constructed from many different materials. In one embodiment, the back reflector 416 comprises a material which allows it to be extruded for efficient, cost-effective production. Some acceptable materials include polycarbonates, such as Makrolon 6265× or FR6901 (commercially available from Bayer) or BFL4000 or BFL2000 (commercially available from Sabic). Many other materials may also be used to construct the back reflector 416. Using an extrusion process for fabrication, the back reflector 416 is easily scalable to accommodate lighting assemblies of varying length.

The back reflector 416 is an example of one shape that may be used in the lighting subassembly 400. The back reflector 416 may be designed to have several different shapes to perform particular optical functions, such as color mixing and beam shaping, for example. The back reflector 416 may be rigid, or it may be flexible in which case it may be held to a particular shape by compression against other surfaces. Emitted light may be bounced off of one or more surfaces. This has the effect of disassociating the emitted light from its initial emission angle. Output color uniformity typically improves with an increasing number of bounces, but each bounce has an associated optical loss. In some embodiments an intermediate diffusion mechanism (e.g., formed diffusers and textured lenses) may be used to mix the various colors of light.

The back reflector 416 should be highly reflective in the wavelength ranges emitted by the source(s) 122. In some embodiments, the reflector may be 93% reflective or higher. In other embodiments it may be at least 95% reflective or at least 97% reflective.

The back reflector 416 may comprise many different materials. For many indoor lighting applications, it is desirable to present a uniform, soft light source without unpleasant glare, color striping, or hot spots. Thus, the back reflector 416 may comprise a diffuse white reflector such as a microcellular polyethylene terephthalate (MCPET) material or a Dupont/WhiteOptics material, for example. Other white diffuse reflective materials can also be used.

Diffuse reflective coatings may be used on a surface of the back reflector to mix light from solid state light sources having different spectra (i.e., different colors). These coatings are particularly well-suited for multi-source designs where two different spectra are mixed to produce a desired output color point. For example, LEDs emitting blue light may be used in combination with other sources of light, e.g., yellow light to yield a white light output. A diffuse reflective coating may eliminate the need for additional spatial color-mixing schemes that can introduce lossy elements into the system; although, in some embodiments it may be desirable to use a diffuse surface in combination with other diffusive elements. In some embodiments, the surface may be coated with a phosphor material that converts the wavelength of at least some of the light from the light emitting diodes to achieve a light output of the desired color point.

By using a diffuse white reflective material for the back reflector 416 and by positioning the light sources to emit light first toward the back reflector 416 several design goals are achieved. For example, the back reflector 416 performs a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The back reflector 416 can comprise materials other than diffuse reflectors. In other embodiments, the back reflector 416 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

In this embodiment, a small percentage, if any, of the light emitted from the sources 410 is directly incident on the lenses 404. Instead, most of the light is first redirected off of the back reflector 416. This first bounce off the back reflector 416 mixes the light and reduces imaging of any of the discrete light sources 410. However, additional mixing or other kinds of optical treatment may still be necessary to achieve the desired output profile. Thus, the lenses 404 may be designed to perform these functions as the light passes through it. The lenses 404 can comprise many different elements and materials.

In one embodiment, the lenses 404 comprise a diffusive element. A diffusive exit lens functions in several ways. For example, it can prevent direct visibility of the sources and provide additional mixing of the outgoing light to achieve a visually pleasing uniform source. However, a diffusive exit lens can introduce additional optical loss into the system. Thus, in embodiments where the light is sufficiently mixed by the back reflector 416 or by other elements, a diffusive exit lens may be unnecessary. In such embodiments, a transparent glass exit lens may be used, or the exit lens may be removed entirely. In still other embodiments, scattering particles may be included in the exit lens 104. Some embodiments may include a specular or partially specular back reflector. In such embodiments, it may be desirable to use a diffuse exit lens.

Diffusive elements in the lenses 404 can be achieved with several different structures. A diffusive film inlay can be applied to the top- or bottom-side surface of the lenses 404. It is also possible to manufacture the lenses 404 to include an integral diffusive layer, such as by coextruding the two materials or by insert molding the diffuser onto the exterior or interior surface. A clear lens may include a diffractive or repeated geometric pattern rolled into an extrusion or molded into the surface at the time of manufacture. In another embodiment, the exit lens material itself may comprise a volumetric diffuser, such as an added colorant or particles having a different index of refraction, for example.

In other embodiments, the lenses 404 may be used to optically shape the outgoing beam with the use of microlens structures, for example. Microlens structures are discussed in detail in U.S. patent application Ser. No. 13/442,311 to Lu, et al., which is commonly assigned with the present application to CREE, INC. and incorporated by reference herein.

FIG. 6 is a perspective view of another lighting subassembly 600 that may be used in conjunction with the housing subassembly 102. It is understood that the lighting subassembly 102 is simply another exemplary embodiment of a lighting subassembly, and that many different lighting subassemblies may be used to provide a particular lighting effect. The lighting subassembly 600 is particularly well-suited for use with solid state light emitters, such as LEDs or vertical cavity surface emitting lasers (VCSELs), for example. However, other kinds of light sources may also be used. An elongated body 602 provides the primary mechanical structure for the lighting subassembly 600. An exit lens 104 provides a transmissive window through which light is emitted. End caps 106 cover the ends of the housing 102 and hold the housing 102 and the exit lens 104 in place. The housing 102, exit lens 104, and end caps 106 define an internal cavity that houses several elements including the light sources and the driver electronics as shown in detail herein. In this embodiment a sensor 108 protrudes through the body 102. Information from the sensor 108 is used to control the internal light sources. The lighting subassembly 600 can be attached to a housing assembly such as the housing assembly 102. The two subassemblies 102, 600 may be attached using a snap-fit structure, screws, or the like. In some instances a more permanent attachment mechanism may be used such as adhesive, for example.

Figure 7:
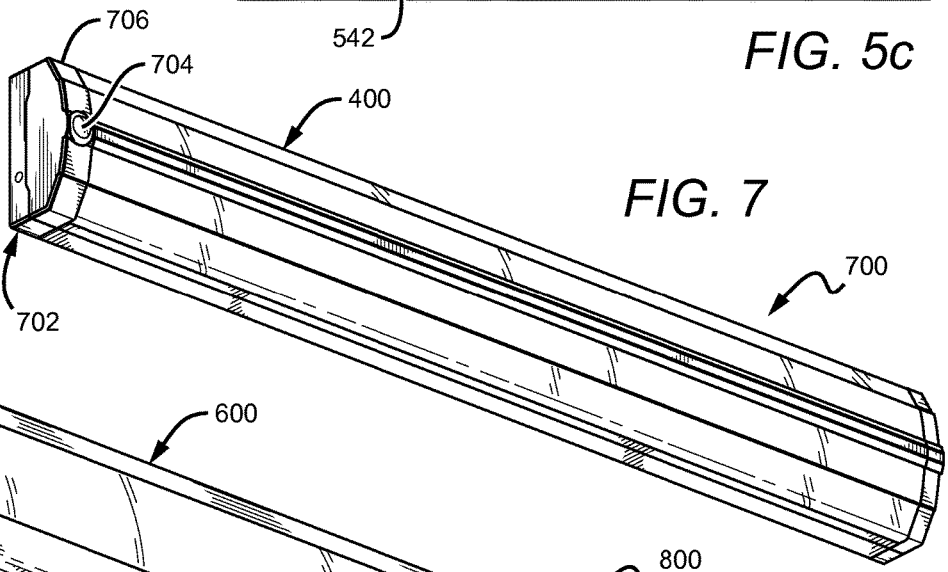
FIG. 7 is a perspective view of a modular light fixture according to an embodiment of the present invention.

FIG. 7 is a perspective view of an embodiment of a modular light fixture 700. The fixture comprises a housing subassembly 702 removably attached to the lighting subassembly 400 shown in FIG. 4. The fixture 700 is similar to the fixture 100 shown in FIG. 1; however, the fixture 700 comprises a sensor 704. The sensor 704 provides information to the driver circuit that is used to control the light sources. In this embodiment, the sensor 704 is integral with a first end cap 706. Many different kinds of sensors can be used depending on the operating environment and the nature of the objects to be sensed. In other embodiments, a sensor can be located in several different alternate positions such as along the heat sink, for example.

Figure 8:
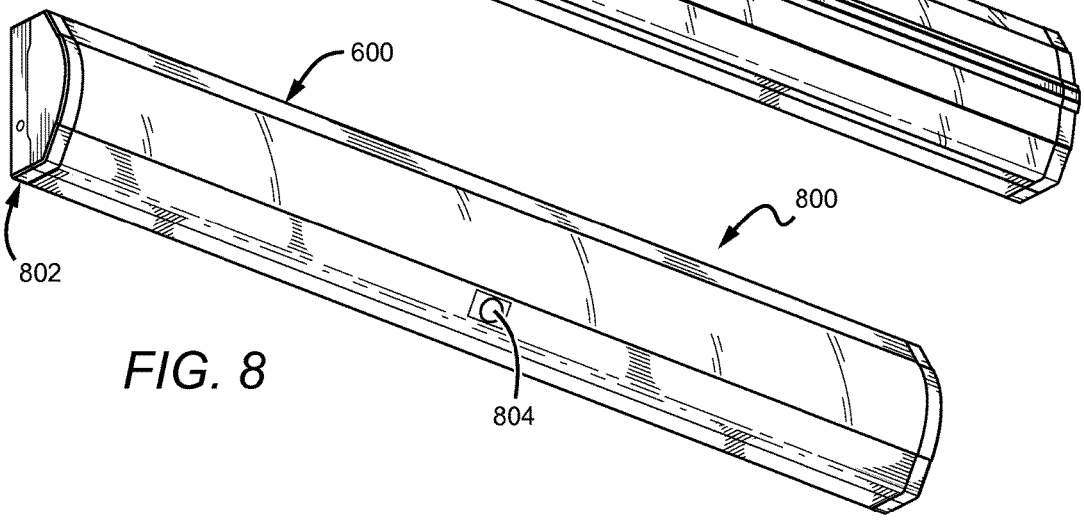
FIG. 8 is a perspective view of a modular light fixture according to an embodiment of the present invention.

FIG. 8 is a perspective view of an embodiment of a modular light fixture 800. The fixture comprises a housing subassembly 802 that is removably attached to the lighting subassembly 600 shown in FIG. 6. This embodiment also comprises the sensor 608 which is integral with the body 602 of the lighting subassembly 600.

Figure 9:
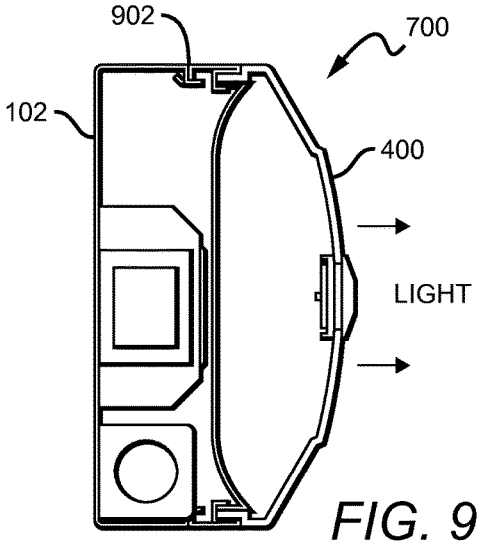
FIG. 9 is a cut-away side view of a modular fixture according to an embodiment of the present invention.

FIG. 9 is a cut-away side view of the modular light fixture 700. The housing subassembly 102 is removably attached to the lighting subassembly 400 with a snap-fit mechanism 902, although other attachment means are possible. The fixture 700 is designed to provide a symmetrical light output wherein the primary direction of the light emission is straight out from the fixture 700 as shown.

Figure 10:
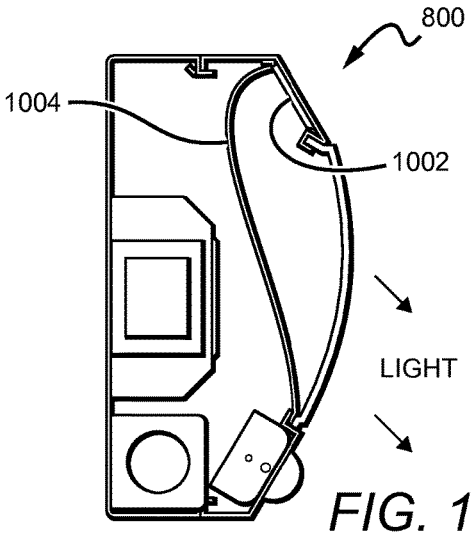
FIG. 10 is a cut-away side view of a modular light fixture according to an embodiment of the present invention.

FIG. 10 is a cut-away side view of the modular light fixture 800. The housing subassembly 102 is removably attached to the lighting subassembly 600 with a snap-fit mechanism 1000, although other attachment means are possible. Dissimilarly from the fixture 700, the fixture 800 is designed to provide an asymmetrical light output distribution. In this particular embodiment, the back reflector 1004 has a curved shape approximated by a spline curve. The shape has an asymmetric transverse cross-section. The back reflector 1004 extends farther in the transverse direction on one side of the light sources 1002 than on the other side. The light sources 1002 are disposed off-center relative to a central longitudinal axis running through the center of the housing 102. Additionally, the light sources 1002 are emit at an angle that is off-center with respect to the back reflector 124; i.e., light emitted from the sources is incident on off-center areas of the back reflector 1004 more heavily. The positioning of the light sources 1002 and the asymmetric shape and placement of the back reflector 1004 result in an asymmetric light distribution. Such an output is useful for lighting areas where more light is required in a given direction, such as stairwell, for example. In a stairwell it is important to light stairs that descend and/or ascend from a given level; thus, an asymmetric output distribution may be used to direct more of the light into these specific areas, reducing the total amount of light that is necessary to light such as an area.

There are many different light subassembly configurations that can be used to provide an asymmetrical light output distribution. Several such configurations are discussed in U.S. patent application Ser. No. 13/830,698, titled "LINEAR SOLID STATE LIGHTING FIXTURE WITH ASYMMETRIC DISTRIBUTION" to Durkee et al., filed on 14 Mar. 2013, which is commonly owned with the present application by Cree, Inc. and incorporated by reference herein.

Figure 11:
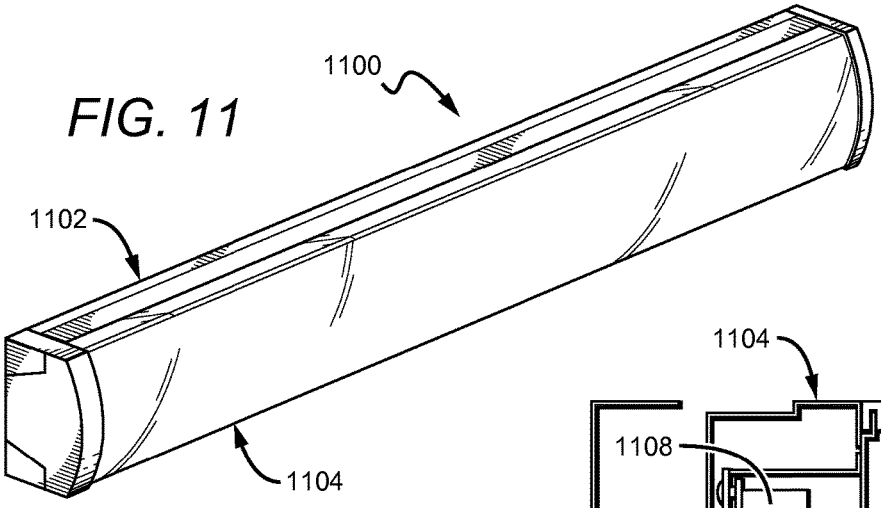
FIG. 11 is a perspective view of a modular light fixture according to an embodiment of the present invention.

FIG. 11 is a perspective view of an embodiment of modular light fixture 1100. This particular embodiment comprises housing subassembly 1102 and a lighting subassembly 1104 that are removably attached.

Figure 12:
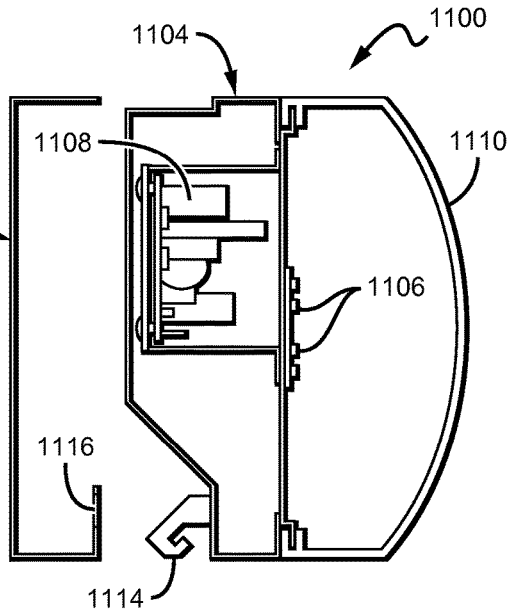
FIG. 12 is a cross-sectional view of a modular light fixture according to an embodiment of the present invention.

FIG. 12 is a cross-sectional view of the fixture 1100. The housing subassembly 1102 and the lighting subassembly 1104 are shown detached. In this embodiment, light sources 1106 and driver electronics 1108 are both housed within the lighting subassembly. Furthermore, the light sources 1106 are positioned to emit light such that it directly impinges on an exit lens 1110 and passes out of the optical chamber and into the ambient. Thus, the fixture 1100 is a direct lighting fixture as opposed to the indirect fixtures 600, 800 where the light first impinges on a back reflector and is redirected with at least one internal bounce before passing through an exit lens. Here, a back reflector 1112 is behind the initial direction of emission from the sources 1106, redirecting any light that may have not have exited the chamber on the first pass because, for example, of total internal reflection at the lens 1110.

The two subassemblies 1102, 1104 are attached with a hook-and-eye mechanism with the lighting subassembly 1104 comprising a hook 1114 and the housing subassembly comprising the receiving eye 1116. In another embodiment, the hook can be a component of the housing subassembly, and the eye a component of the lighting subassembly.

FIGS. 13*a-c* show perspective views of the fixture 1100 during various stages of installation. In FIG. 13*a* the lighting subassembly 1104 is temporarily suspended from the housing subassembly 1102 by inserting the hooks 1114 into the receiving eyes 1116 such that the internal surfaces of both subassemblies 1102, 1104 are facing away from the mount surface, toward the installer. In FIG. 13*b* the wiring connections 1118 are made joining the wires bringing power from an outside source to the wires connected to the light sources in the lighting subassembly 1104. In FIG. 13*c* the lighting subassembly 1104 is swiveled up about the hooks 1114 and fastened to the housing subassembly 1102, using for example, a snap-fit structure. The wiring connections 1118 are then enclosed within the fixture. It is understood that the method and structures shown in FIGS. 13*a-c* are merely exemplary and that many different mechanisms can be used to attach the two subassemblies 1102, 1104 during installation.

FIGS. 14*a-c* are perspective views of an embodiment of a modular lighting fixture 1400. The fixture 1400 comprises a housing subassembly 1402 and a lighting subassembly 1404 that are removably attached. In this particular embodiment, the end caps 1406 are separate components rather than an integral part of either subassembly. The fixture 1400 can be mounted to a wall (FIG. 14*a*), mounted to a ceiling (FIG. 14*b*), mounted to another surface, or it can be suspended from the ceiling in a pendant configuration (FIG. 14*c*).

Figure 15:
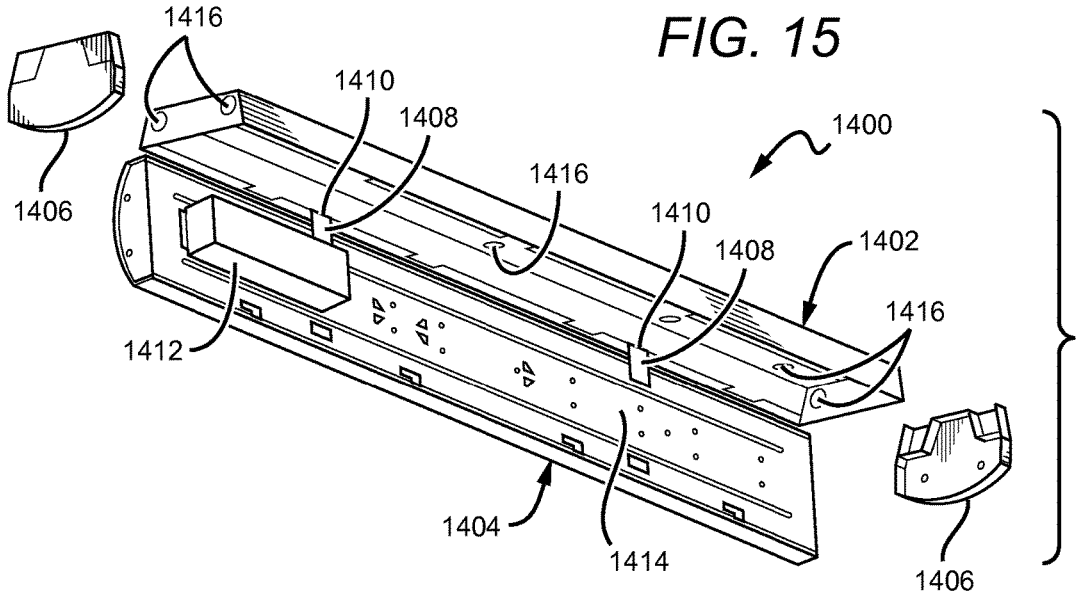
FIG. 15 is an exploded view of a modular light fixture according to an embodiment of the present invention that is mounted to a ceiling.

FIG. 15 is an exploded view of the modular lighting fixture 1400 that is mounted to a ceiling. In this embodiment, the lighting subassembly includes a set of tether clips 1408 that correspond to a set of flanges 1410 on the housing subassembly 1402. During installation the tether clips 1408 are hooked over the flanges 1410 such that the lighting subassembly 1404 may be suspended temporarily from the housing subassembly 1402 which is mounted firmly to the ceiling surface. Once any wiring connections are made, the lighting subassembly 1404 can be swung up to connect to the housing subassembly 1402 with a hook-and-slot mechanism as shown. To complete the attachment, the lighting assembly 1404 hook is aligned with the slot and then slides laterally to engage the housing subassembly 1402. Other mechanisms can be used to attach the subassemblies 1402, 1404 such as a snap-fit structure or the like. Then the end caps 1406 are placed over the ends of both subassemblies 1402, 1404. Then the end caps 1406 may be fastened to the subassemblies 1402, 1404 using a similar snap-fit mechanism, screws, or other structures. The end caps 1406 may also serve to hold the subassemblies firmly together and complete the electronic enclosure.

The driver electronics 1412 are mounted to an interior surface 1414 of the lighting subassembly 1404. The interior surface 1414 can accommodate other electronic components as necessary. When the subassemblies 1402, 1404 are attached, the components on the interior surface 1414 of the lighting assembly 1404 fold into the space hollow space within the housing assembly 1402. Several knockouts 1416 are disposed along the housing subassembly 1402. The knockouts 1416 can be removed to feed wiring into the housing subassembly 1402 for connection with the driver electronics 1412.

Figure 16:
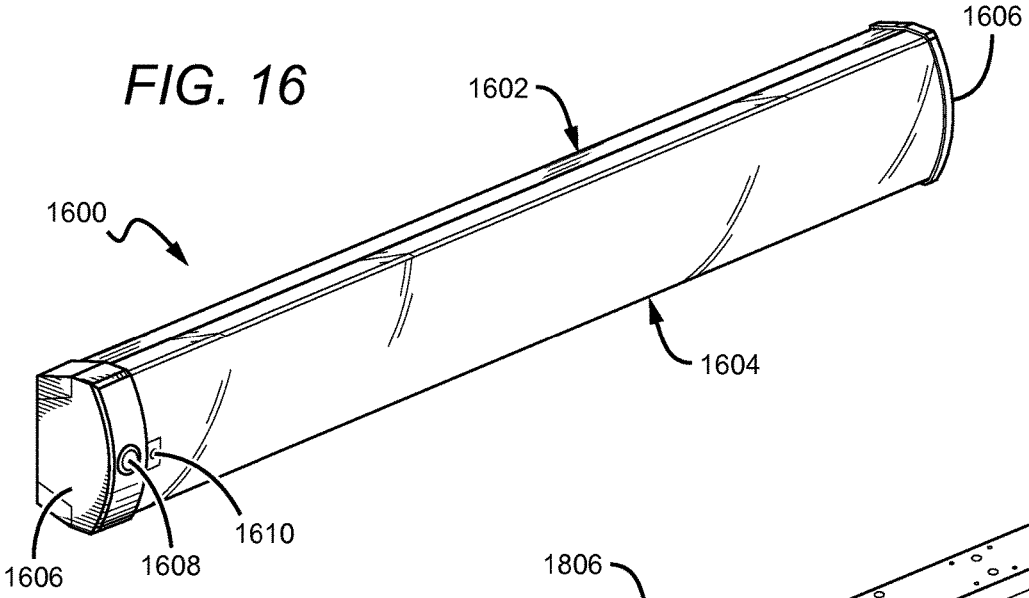
FIG. 16 is a perspective view of a modular light fixture according to an embodiment of the present invention.

FIG. 16 is a perspective view of an embodiment of a modular light fixture 1600. The fixture 1600 is similar to the fixture 1400 also comprising a housing subassembly 1602 that is removably attached to a lighting subassembly 1604. However, the fixture 1600 includes end caps 1606 wherein one of the end caps 1606 has a built-in sensor 1608 to provide information to the drive electronics to control the light sources. A test/reset button 1610 is also included to facilitate maintenance by providing a convenient way to check the operation of the sensor 1608, the light sources, or another electronic component without having to detach the subassemblies 1602, 1604.

Figure 17:
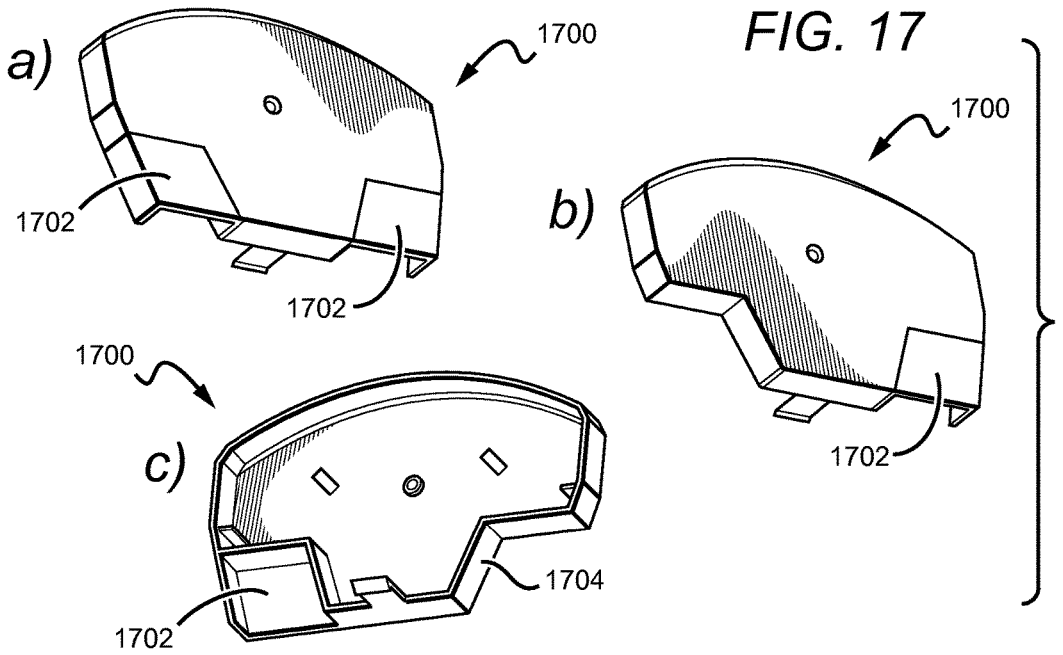
FIGS. 17*a-c* show perspective views of an end cap that may be used in embodiments of present invention.

FIGS. 17*a-c* show perspective views of an end cap 1700 that may be used in embodiments of present invention. The end cap 1700 attaches to the ends of fixtures similar to the fixture 1400. The end cap 1700 comprises knockout portions 1702 that may be removed to provide a pathway for wires running into the fixture housing. FIG. 17*b* shows the end cap 1702 after one of the knockouts has been removed. FIG. 17*c* shows the back side of the end cap 1702 which features a ridge 1704 that outlines a part of the footprint of the knockout 1702. The ridge 1704 provides a smooth reinforced surface for the space that exists after the knockout 1702 is removed. Thus, wiring that runs through into the fixture through the space left by the knockout can freely slide back and forth with minimal fraying and wear, bringing the end cap 1700 into conformity with international standards regarding structures for supporting electrical wiring.

Figure 18C:
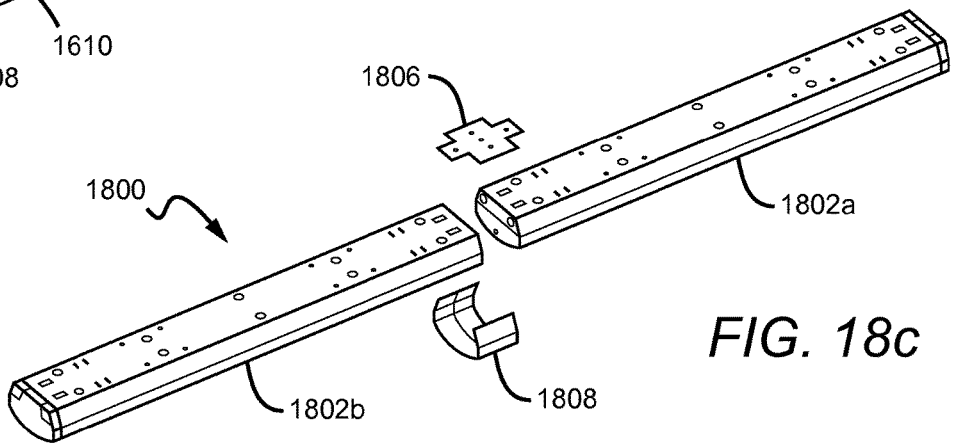
FIGS. 18*a-c* shows an embodiment of an extended modular fixture according to an embodiment of the present invention.
Figure 18A:
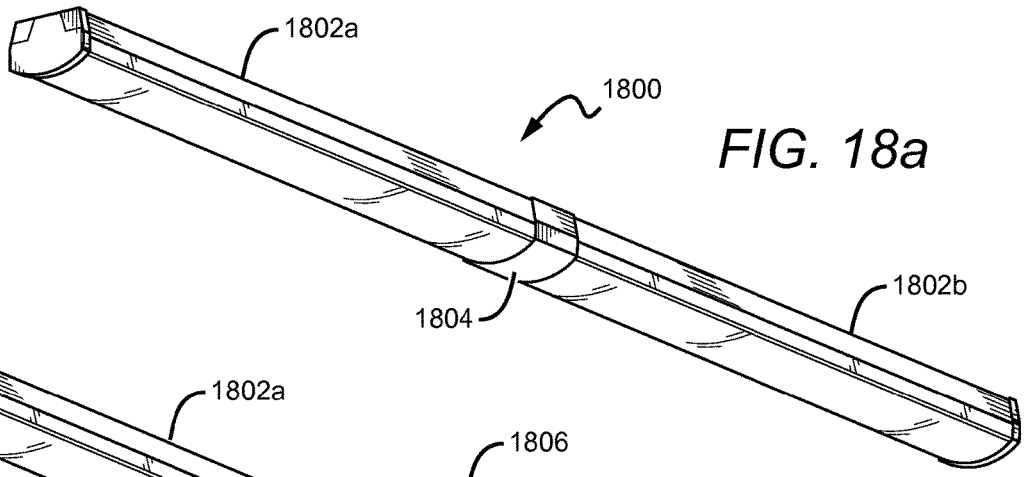
Figure 18B:
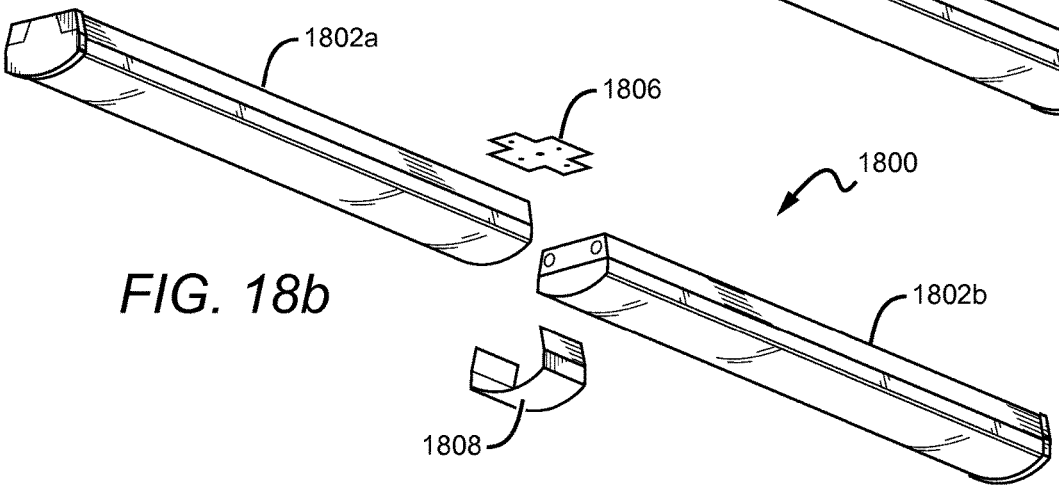

FIGS. 18*a-c* shows an embodiment of an extended modular fixture 1800. FIG. 18*a* shows two smaller linear fixtures 1802*a*, 1802*b*, which are similar to the fixture 1400 in many respects, that have been attached together to form the extended fixture 1800. The intermediate joiner plate 1804 provides the attachment mechanism. The individual fixtures 1802*a*, 1802*b* can be separately connected to a power sources or then can be serially connected with wires passing through the joiner structure 1804 to complete the electrical connection. In this way, additional fixtures may be added to the ends to extend the fixture 1800 in either direction, for example, to light a continuous corridor. FIGS. 18*b* and 18*c* show the fixture 1800 before the small fixtures 1802*a*, 1802*b* have been connected. The joiner structure comprises mount plate 1806 and a sleeve 1808. The mount plate is attached using screws, for example, to the fixtures 1802*a*, 1802*b*, and the sleeve 1808 wraps around to cover the interface. The extended modular fixture 1800 is a ceiling-mounted embodiment. However, it is understood that fixtures may be mounted using other methods, for example, wall-mount, surface-mount, or pendant-mount configurations. Such fixtures may be similarly joined together to create an extended modular fixture having a particular desired length.

FIG. 19 is a perspective view of a modular light fixture 1900 according to an embodiment of the present invention. The fixture 1900 comprises a housing subassembly 1902 and a lighting subassembly 1904 that are removably attached to one another. The lighting subassembly 1904 includes at least one end cap 1906 and a wrap body 1908. The end caps 1906 are shaped to fit snugly over one or both longitudinal ends of the wrap body 1908. The end caps 1906 also provide the structure by which the lighting subassembly 1904 and the housing subassembly 1902 are attached as discussed in more detail herein. The front side of the wrap body 1908 comprises an exit lens 1910. The fixture 1900 is particularly well-suited for mounting to a surface, such as a ceiling or a wall, but it also may be pendant mounted (i.e., suspended) with chains or the like. When the subassemblies 1902, 1904 are attached, the housing subassembly 1902 is almost entirely obscured from observer view.

FIG. 20 is a right end elevation view of the light fixture 1900. The end cap 1906 covers most of the housing subassembly 1902, although some of the housing subassembly 1902 is accessible (by removing knockouts 1912) to allow wiring to pass into the fixture 1900 from the ends, for example, for serial connection with additional fixtures. In this embodiment, the housing subassembly 1902 and lighting subassembly 1904 are removably attached with female and male attachment structures 1914, 1916 as discussed in more detail herein. The housing subassembly 1902 also comprises a screw plate 1917 which is shaped to cooperate with a screw tab 1919 on the end cap 1906. Both the screw tab 1919 and the screw plate 1917 are angled to obscure them from head-on front side view. The screw plate 1917 and the screw tab 1919 may be fastened together with a screw 1921 after the subassemblies 1902, 1904 have been snap fit together to provide a redundant fastening mechanism. This additional fastener may be used to prevent the subassemblies 1902, 1904 from unintentional detachment, for example, if the male attachment structures 1916 were accidentally depressed during cleaning.

Figures 21A, 21B, 21C, 21D, 21E:
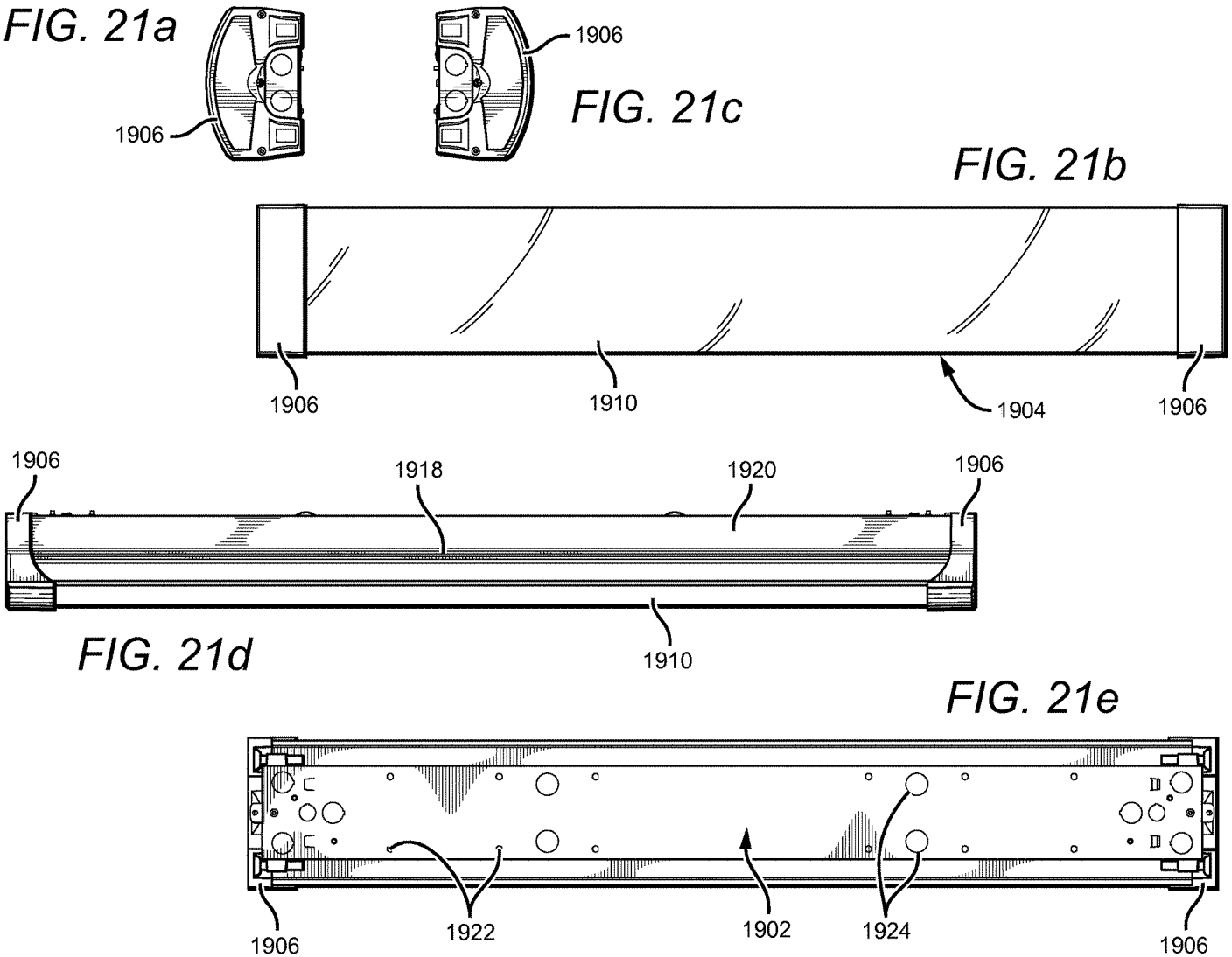
FIG. 21*a* is an internal view of the end of the fixture from cutline a-a according to an embodiment of the present invention.
FIG. 21*b* is a front elevation view of the fixture according to an embodiment of the present invention.
FIG. 21*c* is a right end elevation view of the fixture, with the left end view being identical.
FIG. 21*d* is a right side elevation view of the fixture according to an embodiment of the present invention, with the left side view being identical.
FIG. 21*e* is a back elevation view of the fixture according to an embodiment of the present invention.

FIGS. 21*a-f* represent various elevation views of the fixture 1900: FIG. 21*a* is an internal view of the end of the fixture 1900 from cutline a-a; FIG. 21*b* is a front elevation view of the fixture 1900; FIG. 21*c* is a right end elevation view of the fixture 1900, with the left end view being identical; FIG. 21*d* is a right side elevation view of the fixture 1900, with the left side view being identical; and FIG. 21*e* is a back elevation view of the fixture 1900.

In FIG. 21*a* the left internal end is shown from a vantage point inside the fixture 1900 (i.e., from cutline a-a). Thus, the internal elements of the fixture 1900 are visible as discussed in more detail herein. FIG. 21*d* shows a plurality of ridges 1918 that run longitudinally along the wrap body 1908. The lighting subassembly 1904 comprises an opaque portion 1920 that starts at the ridges 1918 and extends away from the exit lens 1910. The exit lens 1910 and the opaque portion 1920 may be coextruded as a single structure to form the wrap body 1908, or the two components may be manufactured separately and attached afterward. FIG. 21*e* shows the back side of the fixture 1900. The housing subassembly 1902 comprises several mount features 1922 for mounting the fixture 1900 to a surface, such as a ceiling or a wall, or for suspending it from a surface. Knockouts/holes 1924 provide access to the internal components of the fixture. In other embodiments, mount features and knockouts/holes can be added or moved as necessary to accommodate a particular mount configuration.

Figures 22, 23:
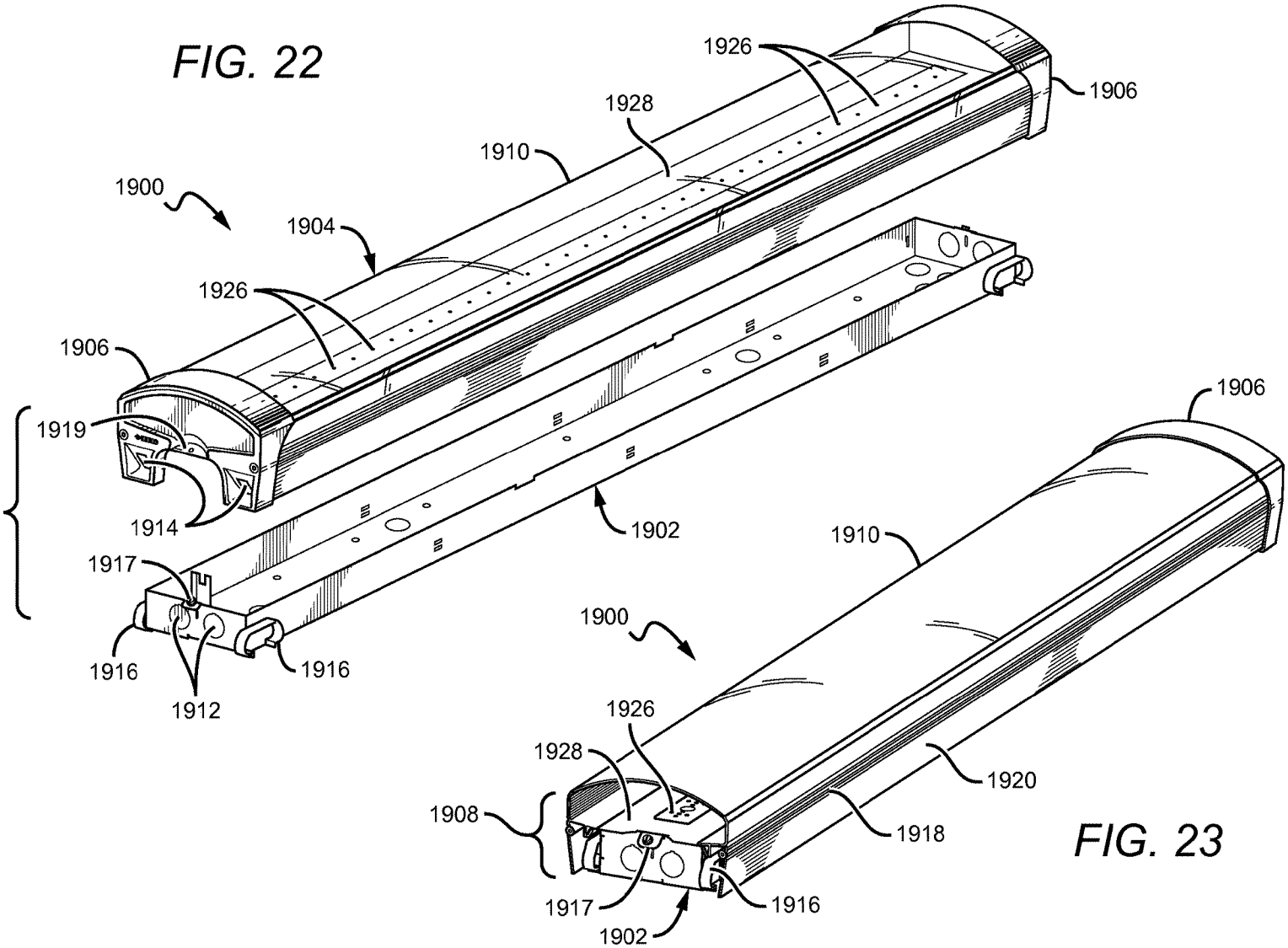
FIG. 22 is a perspective view of the fixture according to an embodiment of the present invention with the housing subassembly and the lighting subassembly detached.
FIG. 23 is a perspective views of the fixture according to an embodiment of the present invention with one of the end caps removed to reveal the internal elements.

FIG. 22 is a perspective view of the fixture 1900 with the housing subassembly 1902 and the lighting subassembly 1904 detached. When the subassemblies 1902, 1904 are attached the lighting subassembly 1904 slides over the housing subassembly 1902 until the male attachment structures 1916 on the housing subassembly 1902 snap into place within the female attachment structures 1914 on the lighting subassembly 1904, securing the two subassemblies 1902, 1904 together. In this embodiment, a male attachment structure 1916 is attached to each corner of the housing subassembly 1902. The male attachment structures 1916 may be attached to the housing subassembly 1902 using screws, adhesives, or the like. The female attachment structures 1914 are defined by cutaway portions of the end caps 1906. The attach/detach mechanism allows for the housing subassembly 1902 to remain mounted to a surface while the lighting subassembly 1904 is easily and safely removed for maintenance or replacement.

In this embodiment, the exit lens 1910 is translucent such that the internal components are visible. A plurality of light sources 1926 on a platform 1928 can be seen through the exit lens 1910. This particular lighting subassembly 1904 provides a direct lighting scheme. That is, a significant portion of the light emitted from the sources 1926 passes through the exit lens 1910 without first being redirected by another surface within the fixture 1900. Other embodiments may include internal reflective surfaces that interact with the light prior to emission from the fixture. Indeed, many different internal optical configurations are possible to achieve a particular output profile.

FIG. 23 is a perspective views of the fixture 1900 with one of the end caps 1906 removed to reveal the internal elements. The light sources 1926 are on the platform 1928, both of which are surrounded on three sides by exit lens 1910 portion of the wrap body 1908. The platform 1928 is adjacent to the housing subassembly 1902 as shown in more detail in FIG. 24.

FIG. 24 is an elevation view of the fixture 1900 with the end cap 1906 removed to reveal the internal elements. The end cap 1906 may be attached to the wrap body 1908 with screws, adhesives, or the like. In this embodiment, bore holes 1930 on both sides of the wrap body 1908 receive screws that fasten the end cap 1906 thereto to complete the lighting subassembly 1904 structure. The wrap body 1908 comprises the exit lens 1910 and the opaque portion 1920. The exit lens 1910 constitutes the portion of the wrap body 1908 toward the front of the lighting subassembly 1904, with the opaque portion 1920 beginning at the ridges 1918 and extending toward the back of the lighting subassembly 1904. As noted, the wrap body may be coextruded as a monolithic element, or the exit lens 1910 and the opaque portion 1920 can be manufactured separately and then attached to form the wrap body 1908.

In this embodiment, the light sources 1926 are on a light strip 1932, similar to those described herein with reference to FIGS. 5*a-c*, which is then affixed to the front side mount surface of the platform 1928. The platform 1928 slides into locking channels 1935 which are defined by internal flanges 1934 that protrude in from the wrap body 1908. Once in place, the platform 1928 and the exit lens 1910 define an optical cavity 1936. In this embodiment, the distance (d) from the top of the light sources 1926 to the exit lens 1910 is approximately 46.34 mm, measured orthogonally from a point along a central longitudinal axis to the inner surface of the exit lens 1910. A range of distances d may be used in various embodiments. In some embodiments d ranges between 46.34±5 mm. Other embodiments may have d ranging between 46.34±10 mm. In still other embodiments d ranges from 46.34±15 mm. Surfaces of the flanges 1934 and the platform 1928 that face the optical cavity 1936 are reflective so that any light incident on those surfaces is redirected back toward the exit lens 1910. In this embodiment, the internal side surfaces 1938 are textured or coated to give them a diffusive quality. For example, a sawtooth pattern may be rolled into these surfaces 1938 to provide the required texturing. This diffusive treatment reduces any imaging (or pixilation) of the light sources 1926 visible from the sides of the fixture 1900.

FIG. 25 is an elevation view of the end cap 1906, which has been removed from the wrap body 1908. The end cap is shaped to define the female attachment structures 1914. These structures 1914 include a tapered lead-in surface to urge the male attachment structures 1916 into a snap-fit arrangement when the housing subassembly 1902 engages with the end cap 1906. Once engaged, the screw tab 1919 can be attached affixed to the screw plate 1917 of the housing subassembly 1902 to provide the redundant attachment mechanism. The end cap 1906 is shaped to define an access space 1940 so that wires can be fed into the housing subassembly 1902 when attached thereto. For example, when the subassemblies 1902, 1904 are attached, the access space 1940 allows for easy access to the knockouts 1912 that can be removed to provide a conduit to internal components. Screw holes 1942 may be used to attach the end cap 1906 to the wrap body 1908. The end cap 1906 also features a recessed portion 1944 that protrudes slightly into the internal space of the fixture 1900. In some embodiments, the recessed portion 1944 may feature snap-fit indentations or other mechanical features to facilitate serial connection.

Figure 26:
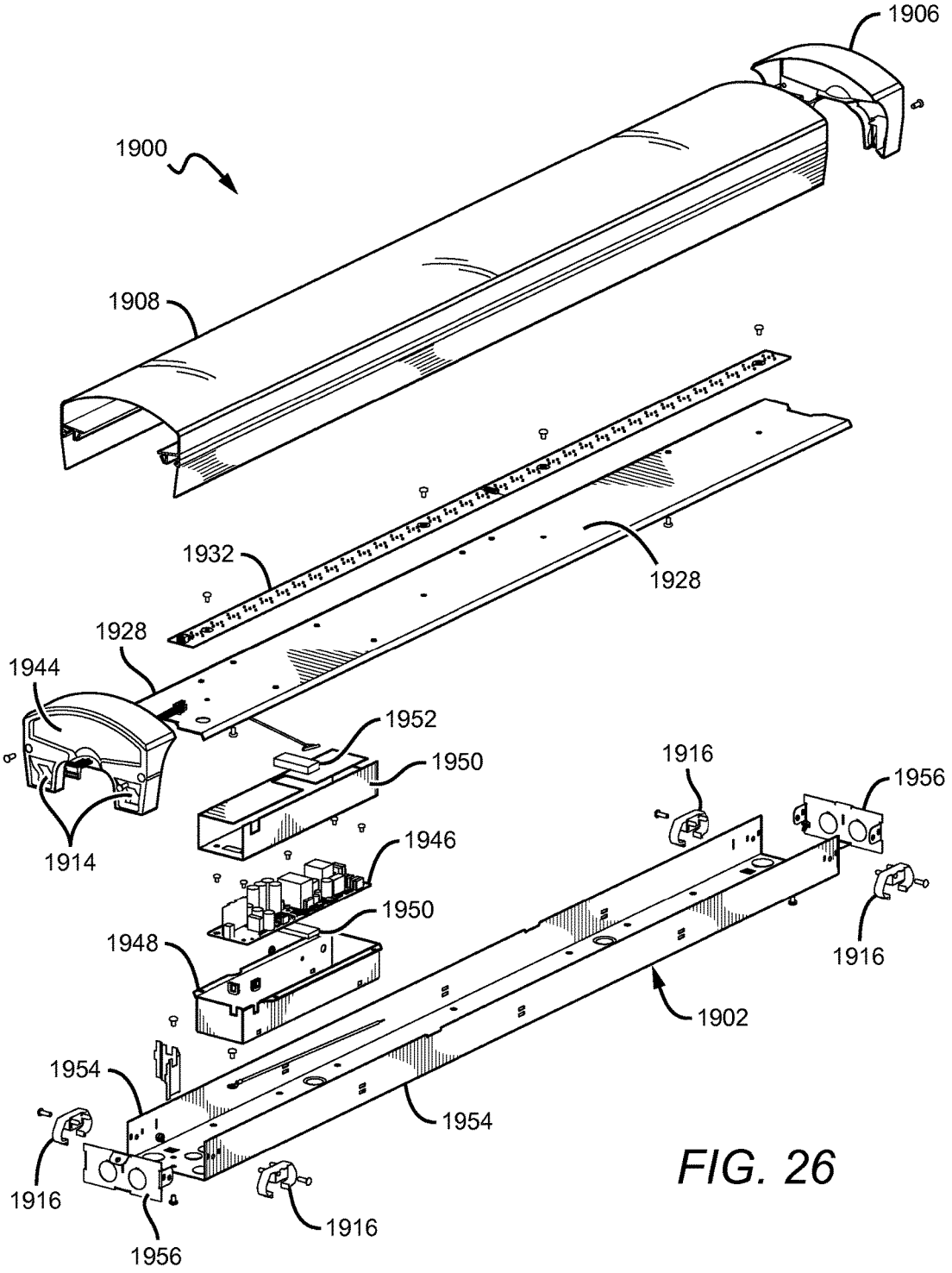
FIG. 26 is an exploded view of the fixture according to an embodiment of the present invention with the components of the subassemblies separated to reveal the internal components.

FIG. 26 is an exploded view of the fixture 1900 with the components of the subassemblies 1902, 1904 separated to reveal the internal components. The light strip 1926 is mounted to the platform 1928 on the front side, using screws or a thermal adhesive for example. Driver electronics 1946 are arranged on the back side of the platform 1928, opposite but proximate to the light sources 1926 that they power. The driver electronics 1946 are disposed within a driver housing 1948 that is mounted to the platform 1928. An insulator 1950 separates the electronics 1946 from the housing 1948. Thermal pads 1952 may be used to facilitate thermal conduction from the electronics 1946 to the platform 1928 and the housing subassembly 1902 for dissipation into the ambient. In this embodiment, the driver electronics 1946 are housed within the lighting subassembly 1904; however, as discussed herein, it is understood that in other embodiments the driver electronics may be housed within the housing subassembly. In still other embodiments, components of the driver electronics may distributed in both the housing subassembly and the lighting subassembly.

The housing subassembly 1902 comprises a wrap frame 1954 and end plates 1956 at both ends. As previously discussed, the end plates 1956 comprise knockouts 1912 to allow access to the light sources 1926 and the driver electronics 1946. The housing subassembly 1902 may be constructed from many different materials, with cold rolled steel being one acceptable material.

The fixture 1900 may come in various lengths, with some suitable lengths being 4 feet, 2 feet, and 3 feet. Many different base lengths are possible. Some applications require fixtures having longer lengths, such as aisles in a grocery market, for example. In such cases, the fixture 1900 may be serially connected (i.e., daisy-chained) with additional fixtures to achieve the desired aggregate length.

Figure 27:
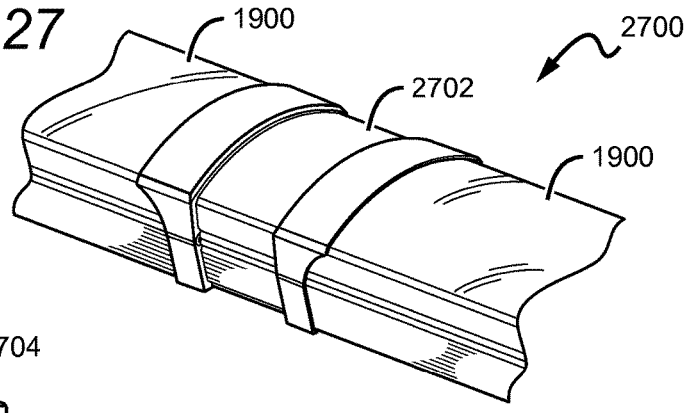
FIG. 27 is a perspective view of an extendable linear fixture according to an embodiment of the present invention.

FIG. 27 is a perspective view of an extendable linear fixture 2700 according to an embodiment of the present invention. The extendable fixture 2700 comprises a plurality of identical fixtures 1900 similar to the fixture 1900. An intermediate bridge structure 2702 is arranged between adjacent fixtures 1900 to connect them.

Figure 28:
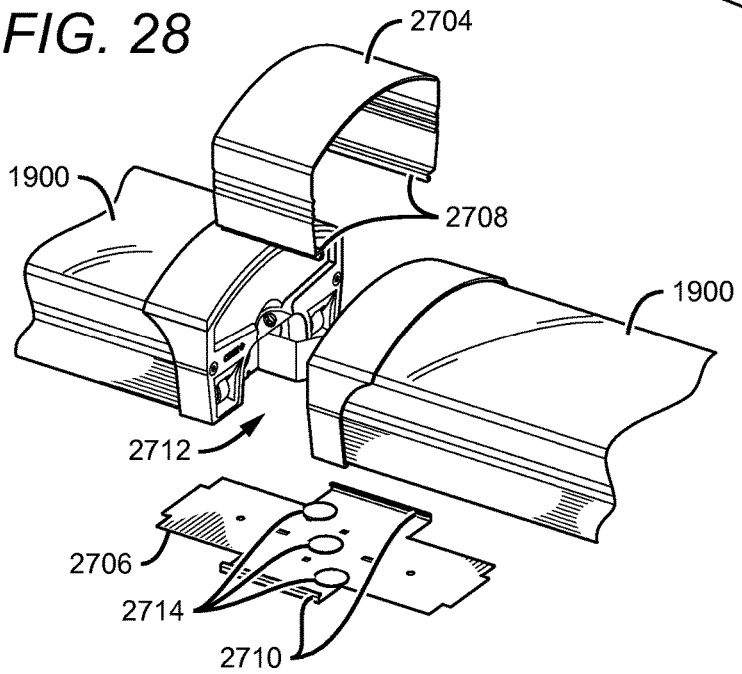
FIG. 28 is a perspective view of adjacent fixtures and an exploded view of the intermediate bridge structure according to an embodiment of the present invention.

FIG. 28 is a perspective view of adjacent fixtures 1900 and an exploded view of the intermediate bridge structure 2702. The bridge structure 2702 comprises an extension piece 2704 and a bracket 2706. The extension piece 2704 is shaped to mimic that of the wrap body 1908 such that bridge structure 2702 is scarcely noticeable to an observer. The bracket 2706 connects to the back side of the adjacent fixtures 1900 with screws or the like. Flanges 2708 at the base of the extension piece is shaped to mate with a ridge 2710 on the front side of the bracket 2706. When assembled, the intermediate bridge structure 2702 and adjacent end caps 1906 define an intermediate enclosure 2712 between the fixtures 1900 where wiring may pass between the fixtures 1900 to achieve the serial connection. Wires may also be routed into the intermediate enclosure 2712 from outside by removing the bracket knockouts 2714. Thus, the bridge structure 2702 provides protection for the wiring and obscures the unsightly connections from view.

FIG. 29 is a right side elevation view of the extendable fixture 2700 along a transverse cutline bisecting the bridge structure 2702. The spring force of the slightly compressed extension piece 2704 urges the flanges 2708 outward against the bracket ridge 2710 such that the extension piece 2704 is held in place between adjacent end caps 1906. In some embodiments, the recessed portion 1944 of the end caps 1906 may comprise a transmissive material or may be removed altogether to provide some side light into the intermediate enclosure 2712 to further camouflage the bridge structure 2702 during operation.

Figure 30:
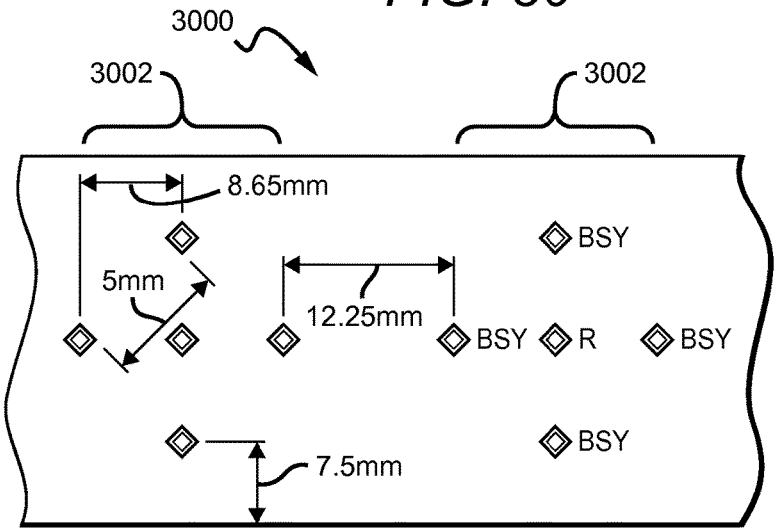
FIG. 30 is a schematic representation of an LED layout on a light strip that may be used in embodiments of the present invention.

FIG. 30 is a schematic representation of an LED layout on a light strip 3000 that may be used in light fixtures according to embodiments of the present invention. In this particular embodiment, the LEDs are arranged in clusters 3002 with each cluster 3002 comprising five discrete light sources: four BSY LEDs (marked BSY) and one red LED (marked R). The BSY LEDs are arranged in a diamond pattern with the red LED in the middle. Each of the LEDs has a square footprint and is rotated 45° such that none of the sides of the LEDs run parallel to the edge of the light strip 3000. It is understood that, in other embodiments, different color combinations may be used and that the LEDs may be arranged and/or rotated in many different ways to achieve a desired output profile.

In this embodiment, the clusters 3002 are spaced longitudinally along the center of the light strip 3000 at an even interval. Here, the distance between the edge of one cluster 3002 and the edge of an adjacent cluster 3002 is approximately 12.25 mm. Within each cluster 3002, the distance between adjacent LEDs around the perimeter of the diamond is approximately 8.65 mm. The distance from each LED on the perimeter to the center LED is approximately 5 mm. The clusters 3002 are arranged in the middle of the light strip 3000 at a distance of approximately 7.5 mm from the lateral edge of the light strip 3000, measured from the edge of the light strip 3000 to the closest LED as shown. It is understood that the arrangement shown in FIG. 30 is merely exemplary. Thus, in other embodiments, the light sources may be spaced differently within each cluster, and the clusters may be spaced at different intervals along the light strip.

Embodiments of the present invention may incorporate various ornamental features to provide an aesthetically pleasing product for installation in residential, commercial, and industrial environments. Several embodiments of such lighting fixtures are disclosed in U.S. Design Pat. App. Ser. No. 29/462,422, titled "SURFACE AMBIENT WRAP LIGHT FIXTURE", which is commonly owned with the present application and filed concurrently herewith. The application referenced in this paragraph is incorporated by reference as if set forth fully herein.

It is understood that embodiments presented herein are meant to be exemplary. Embodiments of the present invention can comprise any combination of compatible features shown in the various figures, and these embodiments should not be limited to those expressly illustrated and discussed. Many other versions of the configurations disclosed herein are possible. Thus, the spirit and scope of the invention should not be limited to the versions described above.

We claim:

1. A modular light fixture, comprising:

a housing subassembly comprising a male attachment structure; and a lighting subassembly, comprising:

at least one end cap, said end cap comprising a female attachment structure for receiving said male attachment structure; and an elongated wrap body, wherein at least a portion of said at least one end cap is over said elongated wrap body;

wherein said housing subassembly is coupled to said light subassembly along a side of said elongated wrap body that is substantially orthogonal to said at least one end cap; and wherein said male attachment structure and said female attachment structure engage to couple said housing subassembly to said at least one end cap such that said housing subassembly and said lighting subassembly are removably attached.

2. The modular light fixture of claim 1, said lighting subassembly further comprising:

said elongated wrap body comprising an opaque portion and an exit lens;

a platform comprising front side and back side mount surfaces, said platform mounted within said body such that an internal optical cavity is defined between said platform and said exit lens;

a plurality of light sources on said front side mount surface of said platform; and driver electronics on said platform back side mount surface and connected to control said plurality of light sources.

3. The modular light fixture of claim 2, said wrap body comprising internal flanges spanning the length of said wrap body on opposite sides and protruding into said optical cavity, said flanges shaped to define locking channels that guide said platform into place and secure said platform within said wrap body.

4. The modular light fixture of claim 3, wherein internal surfaces of said exit lens adjacent to said flanges are textured.

5. The modular light fixture of claim 2, wherein said exit lens is diffusive.

6. The modular light fixture of claim 2, wherein said exit lens is prismatic.

7. The modular light fixture of claim 2, wherein said light sources are on a light strip that is mounted to the front side of said platform.

8. The modular light fixture of claim 1, wherein said male attachment structure and said female attachment structure engage in with a releasable snap-fit mechanism.

9. The modular light fixture of claim 1, wherein:

said male attachment structure comprises flexible tabs on opposite sides of said housing subassembly and protruding past the remainder of said housing subassembly; and said female attachment structure comprises two receiving holes cut away from said at least one end cap, said receiving holes defining a tapered lead-in surface to urge said tabs into a releasable snap-fit arrangement during attachment.

10. The modular light fixture of claim 1, further comprising an intermediate bridge structure at one end of said light fixture, said bridge structure configured to serially connect an additional fixture to form an extended modular light fixture.

11. The modular light fixture of claim 10, said bridge structure comprising:

an extension piece; and a bracket fastened to an end of said housing subassembly and to said extension piece, such that said extension piece abuts and extends away from said at least one end cap.

12. The modular light fixture of claim 11, wherein said extension piece is shaped to substantially match the appearance of said wrap body.

13. The modular light fixture of claim 1, further comprising:

driver electronics, wherein said driver electronics comprise:

an AC/DC converter;

a DC/DC converter; and a battery backup unit.

14. A modular light fixture, comprising:

a housing subassembly comprising a plurality of male attachment structures;

a lighting subassembly, comprising:

an elongated wrap body comprising an opaque portion and an exit lens;

a first end cap and a second end cap, said first and second end caps comprising female attachment structures;

a platform comprising front side and back side mount surfaces, said platform mounted within said body such that an internal optical cavity is defined between said platform and said exit lens; and a plurality of light sources on said front side mount surface of said platform;

wherein said first and second end caps of said lighting subassembly are both removably attached to said housing subassembly.

15. The modular light fixture of claim 14, said female attachment structures configured to receive said plurality of male attachment structures;

wherein said plurality of male attachment structures and said female attachment structures engage such that said housing subassembly and said lighting subassembly are removably attached.

16. The modular light fixture of claim 15, wherein said plurality of male attachment structures and said female attachment structures engage with a releasable snap-fit mechanism.

17. The modular light fixture of claim 15, wherein:

each of said plurality of male attachment structures comprise flexible tabs on opposite sides of said housing subassembly and protruding past the remainder of said housing subassembly; and said female attachment structures each comprise two receiving holes cut away from said at least one end cap, said receiving holes defining a tapered lead-in surface to urge said tabs into a releasable snap-fit arrangement during attachment.

18. The modular light fixture of claim 14, wherein said exit lens is diffusive.

19. The modular light fixture of claim 14, wherein said exit lens is prismatic.

20. The modular light fixture of claim 14, further comprising driver electronics connected to control said plurality of light sources.

21. The modular light fixture of claim 20, wherein said driver electronics comprise:

a power converter; and a battery backup unit.

22. The modular light fixture of claim 20, wherein said driver electronics are on said platform back side mount surface.

23. The modular light fixture of claim 14, further comprising an intermediate bridge structure at one end of said light fixture, said bridge structure configured to serially connect an additional fixture to form an extended modular light fixture.

24. The modular light fixture of claim 23, said bridge structure comprising:

an extension piece; and a bracket fastened to an end of said housing subassembly and to said extension piece, such that said extension piece abuts and extends away from said at least one end cap.

25. The modular light fixture of claim 24, wherein said extension piece is shaped to substantially match the appearance of said wrap body.

26. A modular light fixture, comprising:

a housing subassembly comprising an external mount mechanism and a male attachment structure; and a lighting subassembly comprising:

at least one light source;

driver electronics;

a platform comprising a front side and a back side;

at least one end cap, said end cap comprising a female attachment structure for receiving said male attachment structure; and an elongated wrap body, wherein at least a portion of said at least one end cap is adjacent to said elongated wrap body;

wherein said housing subassembly and said lighting subassembly are removably attached with said at least one end cap; and wherein said platform separates said at least one light source from said driver electronics.

27. The modular light fixture of claim 26, wherein said platform is elongated and comprises a front side surface and a back side surface, wherein at least one light source is on said front side surface and said driver electronics are on said back side surface.

28. The modular light fixture of claim 27, said lighting subassembly further comprising an electronics enclosure on said back side surface and enclosing said driver electronics.

29. The modular light fixture of claim 26, wherein said driver electronics comprise:

an AC/DC converter;

a DC/DC converter; and a battery backup unit.

30. An extendable linear fixture, comprising:

a plurality of modular fixtures, each of said modular fixtures comprising:

a housing subassembly comprising a plurality of male attachment structures; and a lighting subassembly comprising a first end cap and a second end cap, said first and second end caps each comprising a female attachment structure for receiving a respective one of said male attachment structures, said lighting assembly further comprising a lens wherein at least a portion of said at least one end cap is adjacent to at least a portion of said lens;

wherein said plurality of male attachment structures and said first and second female attachment structures engage to couple said housing subassembly to said first and second end caps such that said housing subassembly and said lighting subassembly are removably attached; and at least one intermediate bridge structure, one of said at least one intermediate bridge structures between adjacent of said modular fixtures and connecting said modular fixtures together.

31. The extendable linear fixture of claim 30, each of said at least one intermediate bridge structures comprising:

an extension piece; and a bracket fastened to said housing subassemblies of said adjacent modular fixtures and to said extension piece, such that said extension piece, said bracket and said adjacent modular fixtures define an intermediate enclosure.

32. The extendable linear fixture of claim 31, wherein said adjacent modular fixtures are serially connected with wires passing through said intermediate enclosure.

* * * * *